US009937715B2

(12) United States Patent
Masuda et al.

(10) Patent No.: US 9,937,715 B2
(45) Date of Patent: Apr. 10, 2018

(54) INKJET RECORDING METHOD AND INKJET RECORDING DEVICE

(71) Applicants: Kiminori Masuda, Tokyo (JP); Satomi Araki, Kanagawa (JP); Michihiko Namba, Kanagawa (JP); Hiroaki Takahashi, Kanagawa (JP); Amika Sagara, Tokyo (JP)

(72) Inventors: Kiminori Masuda, Tokyo (JP); Satomi Araki, Kanagawa (JP); Michihiko Namba, Kanagawa (JP); Hiroaki Takahashi, Kanagawa (JP); Amika Sagara, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/350,611

(22) Filed: Nov. 14, 2016

(65) Prior Publication Data

US 2017/0151780 A1 Jun. 1, 2017

(30) Foreign Application Priority Data

Nov. 30, 2015 (JP) ..... 2015-233241
May 30, 2016 (JP) ..... 2016-107211

(51) Int. Cl.
*B41J 2/045* (2006.01)

(52) U.S. Cl.
CPC ..... *B41J 2/04588* (2013.01); *B41J 2/04586* (2013.01)

(58) Field of Classification Search
CPC ..... B41J 2/04588; B41J 2/04586
See application file for complete search history.

(56) References Cited

U.S. PATENT DOCUMENTS

| | | | |
|---|---|---|---|
| 2010/0245416 | A1 | 9/2010 | Ohshima et al. |
| 2011/0063351 | A1 | 3/2011 | Kitaoka |
| 2013/0307912 | A1 | 11/2013 | Masuda et al. |
| 2014/0240384 | A1 | 8/2014 | Yokomaku |
| 2014/0253618 | A1 | 9/2014 | Masuda et al. |
| 2015/0174920 | A1 | 6/2015 | Namba et al. |
| 2015/0258796 | A1 | 9/2015 | Tamai et al. |
| 2015/0259567 | A1 | 9/2015 | Tamai et al. |
| 2015/0283828 | A1 | 10/2015 | Aoai et al. |

(Continued)

FOREIGN PATENT DOCUMENTS

| | | |
|---|---|---|
| JP | 10-081012 | 3/1998 |
| JP | 2001-146011 | 5/2001 |

(Continued)

*Primary Examiner* — Jason Uhlenhake
(74) *Attorney, Agent, or Firm* — Oblon, McClelland, Maier & Neustadt, L.L.P.

(57) ABSTRACT

An inkjet recording method includes applying one or more drive pulses to a pressure generating device of a recording head including a nozzle plate, a liquid chamber, and discharging droplets of ink from the nozzle. Also, the following conditions 1 and 2 are satisfied.

1. The ink has a dynamic surface tension 10 mN/m or more greater than the static surface tension of the ink when the surface life length is 15 ms and 3 mN/m or more greater than the static surface tension of the ink when the surface life length is 1,500 ms, as measured by maximum bubble pressure technique at 25 degrees C.

2. At least one of the drive pulses has a voltage changing portion to draw in the ink, the voltage changing portion having a changing time of one third or more of the resonance period of the liquid chamber.

20 Claims, 19 Drawing Sheets

(56) References Cited

U.S. PATENT DOCUMENTS

| | | | |
|---|---|---|---|
| 2015/0367667 | A1 | 12/2015 | Aoai et al. |
| 2016/0024323 | A1 | 1/2016 | Tamai et al. |
| 2016/0144620 | A1 | 5/2016 | Masuda et al. |
| 2016/0185110 | A1 | 6/2016 | Masuda et al. |
| 2016/0222234 | A1 | 8/2016 | Matsuyama et al. |
| 2016/0264807 | A1 | 9/2016 | Sagara et al. |

FOREIGN PATENT DOCUMENTS

| | | |
|---|---|---|
| JP | 2008-001003 | 1/2008 |
| JP | 2008-308666 | 12/2008 |
| JP | 2011-062821 | 3/2011 |
| JP | 2014-162221 | 9/2014 |
| JP | 2014-195986 | 10/2014 |
| JP | 2015-071291 | 4/2015 |

INKJET RECORDING METHOD AND INKJET RECORDING DEVICE

CROSS-REFERENCE TO RELATED APPLICATIONS

This patent application is based on and claims priority pursuant to 35 U.S.C. § 119 to Japanese Patent Application No. 2015-233241 and 2016-107211, filed on Nov. 30, 2015 and May 30, 2016, in the Japan Patent Office, the entire disclosures of which is hereby incorporated by reference herein.

BACKGROUND

Technical Field

The present invention relates to an inkjet recording method and an inkjet recording device.

Description of the Related Art

In inkjet recording methods, ink droplets are discharged from extremely fine nozzles and attached to a recording medium to form texts and images. This method is advantageous and diffusing since full colorization is easy and high resolution images can be obtained by a simple device in comparison with other recording methods.

Ink for use in such an inkjet recording method is demanded to have various characteristics. In particular, discharging stability of ink discharged from a head greatly affects the image quality.

In the inkjet recording method described above, pressures applied to the ink are fluctuated to discharge ink droplets.

More specifically, a meniscus is formed inside a nozzle of a head filled with ink. In normal state (stationary condition), the meniscus forms a bridge on the side of a liquid chamber with a nozzle edge as a reference point. However, when the ink in the nozzle receives a positive pressure as the pressure changes during discharging, the meniscus collapses and the ink may overflow outside the discharging orifice of the ink. In addition, fine ink mist may be developed when tails of ink droplets discharged are broken off or ink crashes on a print target resulting in scattering and such mist tends to adhere to the surface of the nozzle plate. The ink overflowing from the discharging orifice and the ink mist attached to the surface of the nozzle plate form an ink pool on the surface of the nozzle plate. If this pool contacts an ink droplet at the time of discharging, the meniscus is made uneven or the ink droplet is pulled back. For this reason, the discharging direction may be deviated. Furthermore, in a case of ink using a pigment as a coloring agent, the pigment as a solid portion is dispersed in a solvent. When the ink attached to the surface of the nozzle plate is dried, the solid portion is firmly fixed thereon, causing nozzle clogging in the end.

As describe above, in the inkjet recording method, keeping the site around the nozzle clean is demanded to secure stable dischargeability. Therefore, in general, to prevent ink contamination on the surface of the nozzle plate, a repellent film is formed on the surface to easily repel the ink or the surface is regularly wiped off to remove the ink thereon.

However, such a repellent film is known to be peeled off from the surface of the nozzle plate little by little due to wiping, etc.

Ink tends to adhere to the site where the repellent film is peeled off, which makes discharging unstable. As a consequence, ink deviation (incorrect ink discharging) and streaks occur to printed matter, which degrades the image quality. In addition, depending on the property of ink, the ink strongly sticks to the surface of the nozzle plate, so that the ink is not easily removed by wiping. In particular, when ink having a low static surface tension is discharged from a head, ink displacement and streaks occur to printed matter at sites where the repellent film is peeled off, which has an adverse impact on the image quality.

However, when the repellent film formed on the surface of a nozzle plate is degraded, there is still room for improvement to stably discharge ink having a large difference between the dynamic surface tension and the static surface tension in conventional methods.

SUMMARY

According to the present invention, provided is an improved inkjet recording method including applying one or more drive pulses to a pressure generating device of a recording head, the recording head including a nozzle plate having a nozzle, a liquid chamber communicating with the nozzle, and the pressure generating device to generate a pressure in the liquid chamber and discharging droplets of ink from the nozzle. Also, the following condition 1 and 2 are satisfied.

1. The ink has a dynamic surface tension 10 mN/m or more greater than the static surface tension of the ink when the surface life length is 15 ms and 3 mN/m or more greater than the static surface tension of the ink when the surface life length is 1,500 ms, as measured by maximum bubble pressure technique at 25 degrees C.

2. At least one of the one or more drive pulses has a voltage changing portion to draw in the ink, the voltage changing portion having a changing time of one third or more of a resonance period of the liquid chamber.

BRIEF DESCRIPTION OF THE SEVERAL VIEWS OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

Figure 1:
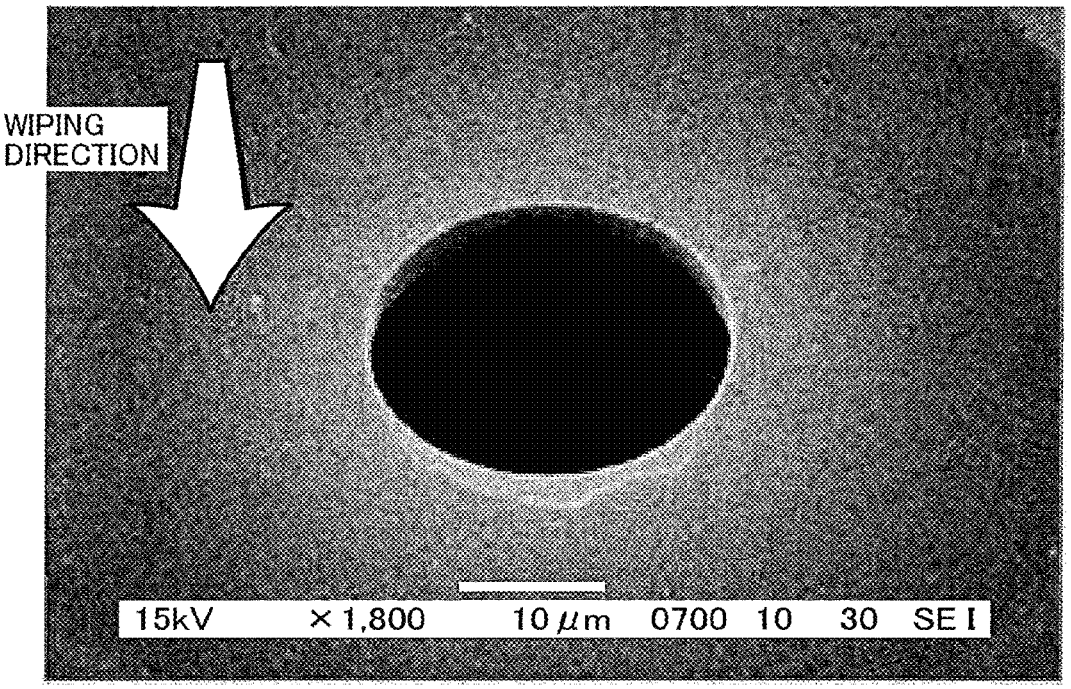
FIG. 1 is a Scanning Electron Microscope (SEM) image illustrating a state in which the repellent film on the surface of a nozzle plate is degraded.

The accompanying drawings are intended to depict example embodiments of the present invention and should not be interpreted to limit the scope thereof. The accompanying drawings are not to be considered as drawn to scale unless explicitly noted.

DESCRIPTION OF THE EMBODIMENTS

Inkjet Recording Method and Inkjet Recording Device

One aspect of the present disclosure is an inkjet recording method of applying one or more drive pulses to a pressure generating device of a recording head including a nozzle plate including a nozzle, a liquid chamber communicating with the nozzle, and the pressure generating device to generate a pressure in the liquid chamber and discharging liquid droplets of ink from the nozzle. Also the following conditions 1 and 2 are satisfied.

1. The dynamic surface tension of the ink is 10 mN/m or more greater than the static surface tension of the ink when the surface life length is 15 ms and 3 mN/m or more greater than the static surface tension of the ink when the surface life length is 1,500 ms, as measured by maximum bubble pressure technique at 25 degrees C.

2. At least one of the one or more drive pulses has a voltage changing portion to draw in the ink having a changing time length of one third or more of a resonance period of the liquid chamber.

One aspect of the present disclosure is an inkjet recording device which includes a recording head including a nozzle plate including a nozzle, a liquid chamber communicating with the nozzle, and a pressure generating device to generate a pressure in the liquid chamber to discharge the droplets of ink and a drive waveform generating unit configured to generate a drive pulse including one or more drive pulses applied to the pressure generating device, wherein the following condition 1 and 2 are satisfied.

Condition 1: The dynamic surface tension of the ink is 10 mN/m or more greater than the static surface tension of the ink when the surface life length is 15 ms and 3 mN/m or more greater than the static surface tension of the ink when the surface life length is 1,500 ms, as measured by maximum bubble pressure technique at 25 degrees C.

Condition 2. At least one of the one or more drive pulses has a voltage changing portion to draw in the ink having a changing time length of one third or more of a resonance period of the liquid chamber.

A flow path plate, a vibration plate, and a nozzle plate are laminated to form the recording head (hereinafter also referred to as a liquid discharging head or head). The vibration plate is attached to the bottom surface of the flow path plate and the nozzle plate is attached to the upper surface of the flow path plate. These form the nozzle (nozzle orifice) having an orifice through which liquid droplets (ink droplets) are discharged. The nozzle to discharge the liquid droplet (ink droplet) communicates with a nozzle communicating path, a liquid chamber serving as a pressure generating chamber, and an ink supply hole communicating with a common liquid chamber to supply the ink to the liquid chamber through a fluid resistance unit (supplying path), etc.

That is, the liquid discharging head includes the nozzle plate, the liquid chamber communicated with the nozzle orifice through which the ink droplet is discharged, and the pressure generating device to change the pressure in the liquid chamber.

The nozzle (nozzle orifice) is formed on the nozzle plate for each liquid chamber. It is preferable that this nozzle plate be formed of, for example, a nozzle forming member such as a metal member and include a repellent layer (film) on the surface of the nozzle forming member on the side of ink discharging. That is, the surface of the nozzle (nozzle orifice) on the side of ink discharging is preferably subjected to repellency treatment.

In the inkjet recording method of the present disclosure, a print control unit, which is described later, generates a discharging pulse in response to the size of ink droplets. A drive pulse is selected from a drive waveform including one or more drive pulses in temporal sequence to form the discharging pulse.

"Drive pulse" means a pulse as an element constituting a drive waveform and "discharging pulse" means a pulse applied to a liquid discharging head including a pressure generating device to discharge ink droplets.

The drive pulse is formed of a waveform element (inflation waveform element) to inflate a liquid chamber by rising-down from a reference voltage to a predetermined hold voltage, a waveform element (holding element) to hold the risen-down voltage (hold voltage), and a waveform element (contraction waveform element) to contract the liquid chamber by rising up from the hold voltage.

Depending on the size of droplets of ink, a drive pulse is selected from a drive waveform including one or more drive pulses in temporal sequence to form the discharging pulse. For example, a drive waveform discharging droplets of three sizes of large droplets, middle-sized droplets, and small droplets can be selected.

FIG. 1 illustrates a scanning electron microscope (SEM) image of a nozzle. As illustrated in FIG. 1, due to physical burden ascribable to maintenance, the nozzle repellent film of the surface of the nozzle plate situated on the opposite side of the liquid chamber gradually deteriorates.

Figure 2:
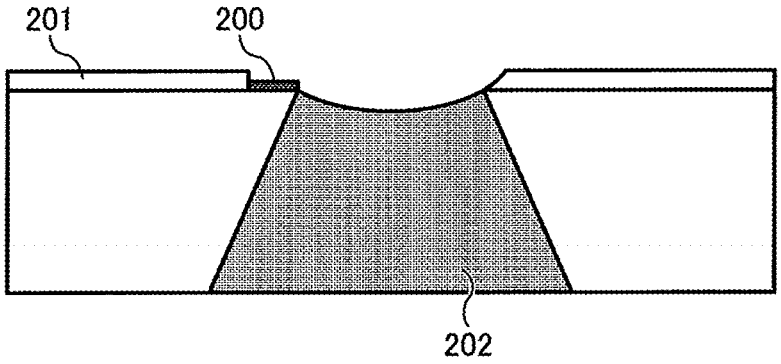
FIG. 2 is a schematic diagram illustrating a state of normal meniscus.

A meniscus is naturally formed inside the nozzle of the head filled with ink. Normally (stationary condition), the meniscus forms a bridge on the side of a liquid chamber with a nozzle edge as a reference point. The deterioration of the nozzle repellent film has little impact (refer to FIG. 2). In FIG. 2, the reference numeral 200 represents a degraded repellent film and the reference numerals 201 and 202, a repellent film and ink, respectively. The same is true in FIGS. 3 to 11. In addition, in the graphs of FIG. 5B to FIG. 11B, the portions in bold represent waveform elements of the drive pulses (discharging pulses). In addition, in the graphs of FIGS. 5B to 11B, X axis represents time and Y axis represents voltage.

Figure 3:
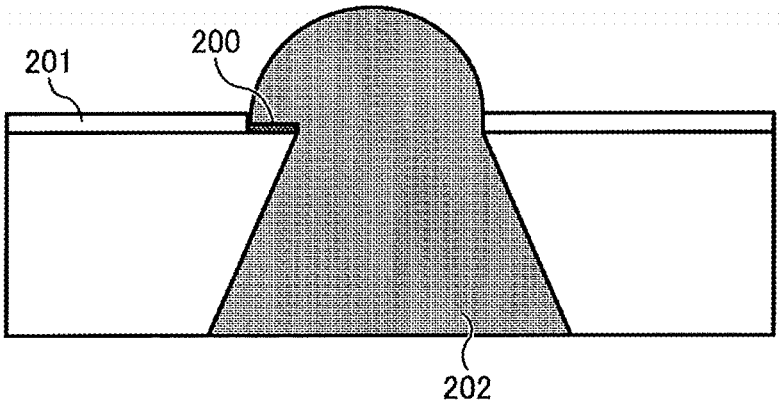
FIG. 3 is a schematic diagram illustrating meniscus overflowing occurring immediately after a liquid droplet is discharged.
Figure 4:
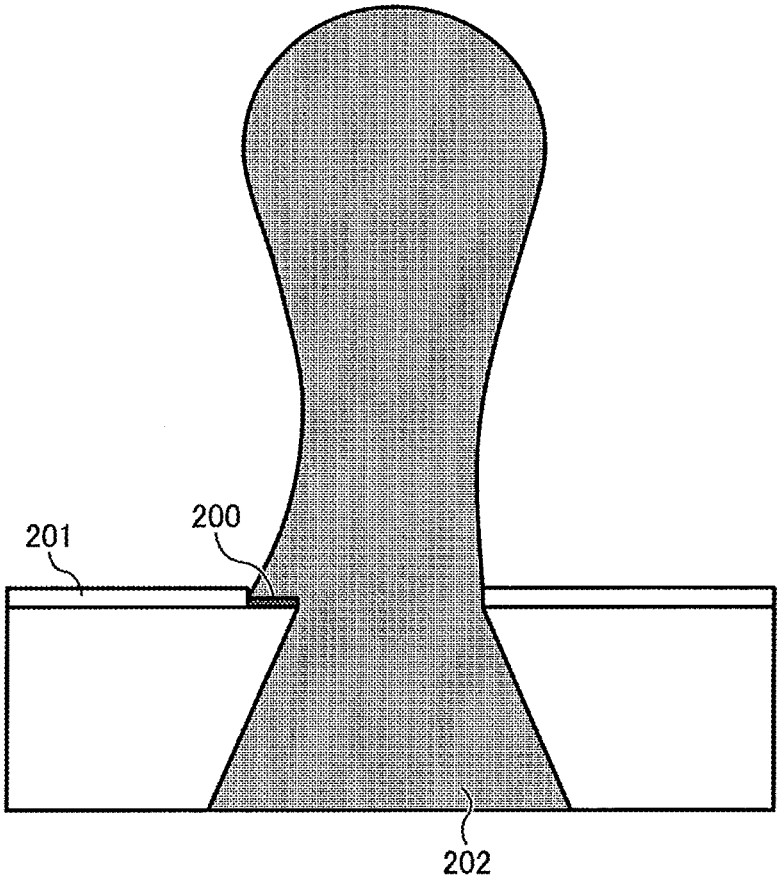
FIG. 4 is a schematic diagram illustrating a state in which deviation of liquid droplet occurs.

As illustrated in FIGS. 3 and 4, when ink protrudes outside a nozzle after discharging of the liquid droplets of the ink 202 such as meniscus overflowing or meniscus overflowing immediately after high frequency drive, the meniscus becomes asymmetric due to the degraded nozzle repellent film. If liquid droplets are discharged while the meniscus is asymmetric, deviation of the liquid droplet occurs (FIG. 4).

"Meniscus overflowing" and "meniscus overflowing immediately after high frequency drive mean the following.

Meniscus Overflowing

A phenomenon in which when a liquid droplet is discharged from a nozzle, the ink flows in from the common liquid chamber as a result of the flow-out of the ink from the nozzle. That flow-in does not stop immediately and goes too far, resulting in meniscus overflowing of ink in the nozzle.

In particular, as the number of waveforms to discharge large size droplets in a single print cycle increases, i.e., waveform having a large discharging amount in a unit of time, the degree of meniscus overflowing becomes large.

Meniscus Overflowing Immediately after High Frequency Drive

A phenomenon in which at the time of flow-out of a massive amount of ink due to high frequency drive, flow-in of the ink from the common liquid chamber does not stop immediately but goes too far, causing meniscus overflowing of the ink in the nozzle. A phenomenon having a refill frequency Rf different from characteristic vibration cycle Tc of a liquid chamber.

As illustrated in FIGS. 5A and 5B to 7A and 7B, in a typical discharging pulse, when a droplet is discharged while meniscus overflowing is occurring, the ink overflown on the degraded repellent film is not sufficiently drawn in. For this reason, the ink overflow remains even just before the droplet is discharged, which causes deviation of the droplet.

Figure 5A:
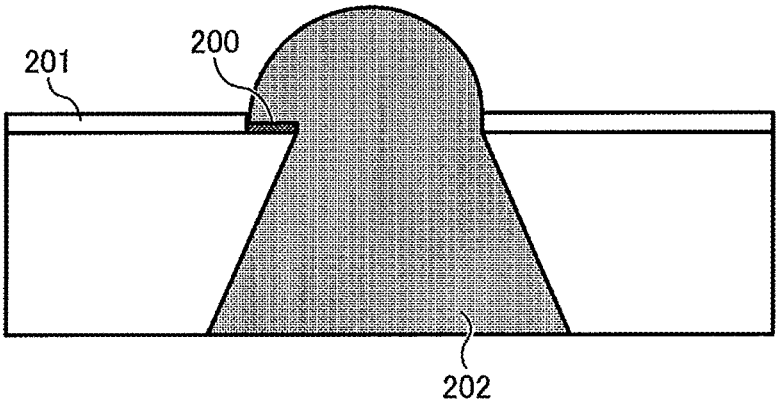
FIG. 5A is a schematic diagram illustrating a state of typical meniscus overflowing in typical discharging.
Figure 5B:
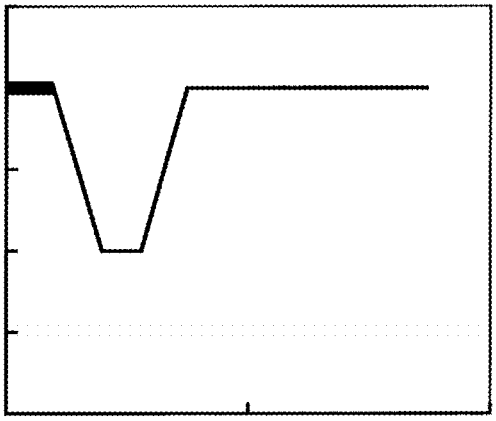
FIG. 5B is a graph illustrating a drive pulse in the state illustrated in FIG. 5A.
Figure 6A:
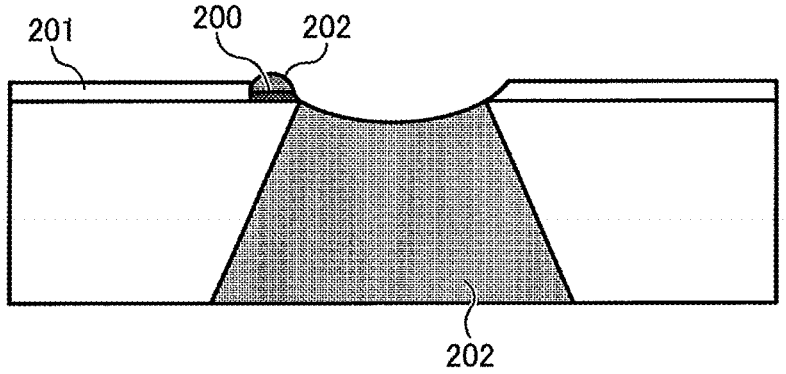
FIG. 6A is a schematic diagram illustrating a state in which ink overflown in typical discharging remains on the repellent film.
Figure 6B:
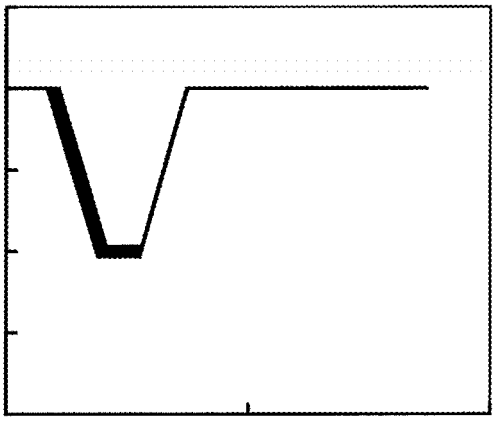
FIG. 6B is a graph illustrating a drive pulse in the state illustrated in FIG. 6A.
Figure 7A:
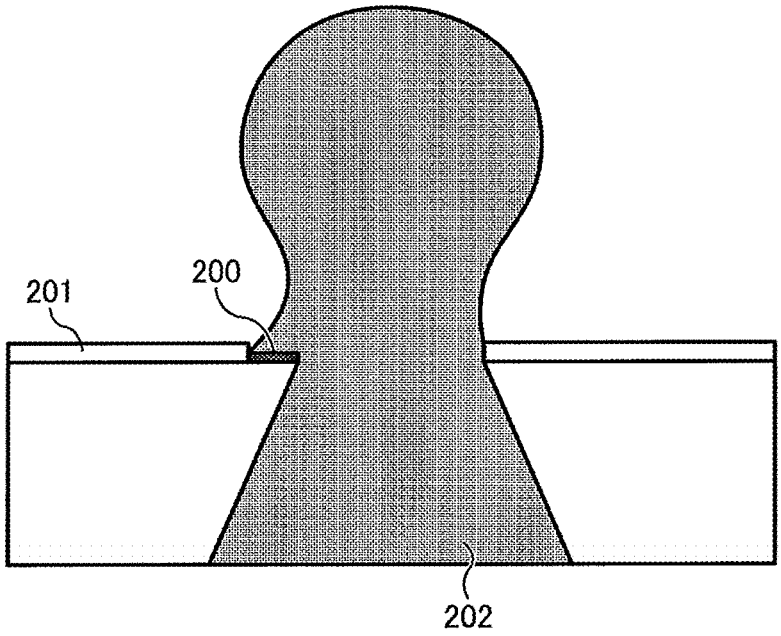
FIG. 7A is a schematic diagram illustrating a state in which deviation of liquid droplet occurs during typical discharging.
Figure 7B:
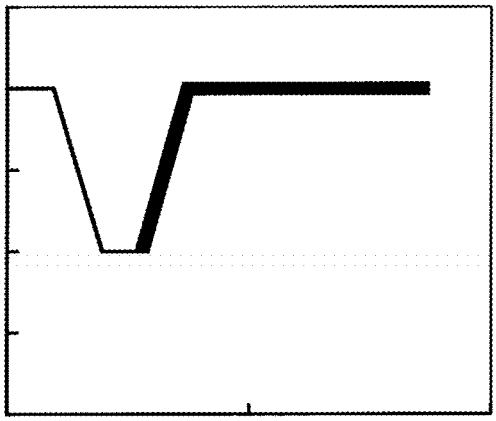
FIG. 7B is a graph illustrating a drive pulse in the state illustrated in FIG. 7A.
Figure 8A:
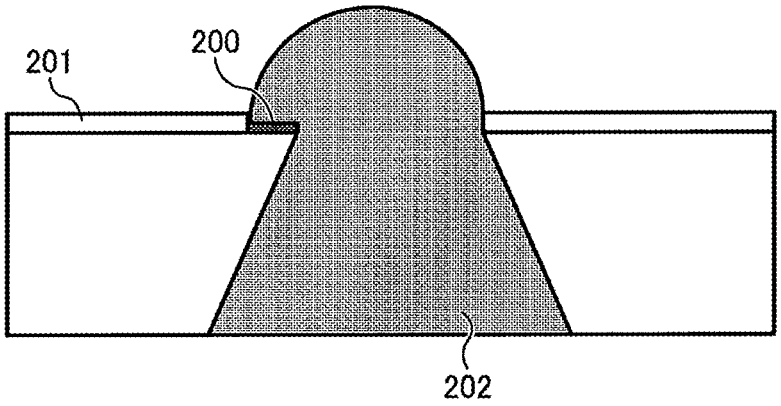
FIG. 8A is a schematic diagram illustrating a state in which meniscus overflowing occurs.
Figure 8B:
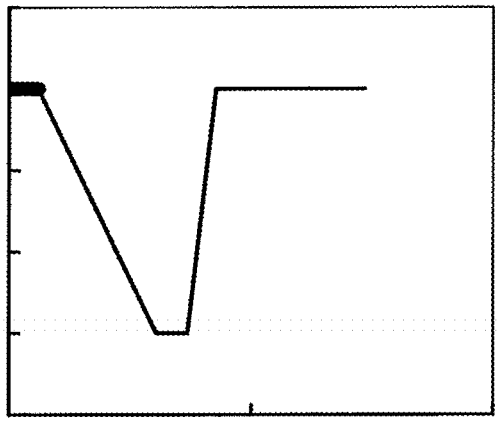
FIG. 8B is a graph illustrating a drive pulse in the state illustrated in FIG. 8A.

FIGS. 5B, 6B, and 7B respectively represent drive pulses in the states illustrated in FIGS. 5A, 6A, and 7A.

This is described in detail. In the state where meniscus overflowing occurs (refer to FIG. 5A), if the meniscus is drawn in the nozzle by a pulse, some of the ink 202 remains on the degraded repellent film 200 as illustrated in FIG. 6A. Thereafter, if the ink 202 is discharged through the nozzle by a discharging pulse to discharge the ink 202 through the nozzle in a state where the ink 202 remains on the degraded repellent film 200, the ink 202 remaining on the degraded repellent film 200 and the discharged ink 202 are united, causing deviation of the liquid droplet as illustrated in FIG. 7A.

On the other hand, in the present disclosure, as illustrated in FIGS. 8A and 8B to 11A and 11B, the meniscus is slowly drawn in. For this reason, the ink 202 does not remain on the degraded repellent film 200. Namely, it is possible to prevent deviation of liquid droplets. The mechanism by which the deviation of liquid droplets are prevented is described below in detail. When drawing the meniscus into a nozzle by a pulse in the state of meniscus overflowing (refer to FIG. 8A), a waveform element (the voltage changing part of rising down illustrated in FIG. 9B) is used which has a relatively slow changing rate with one third of or more of the resonance period (time) of the liquid chamber. That is, the inflation waveform (voltage changing portion to draw in ink) having a voltage changing time (also referred to as elapsed time) having one third or more of the resonance period of the liquid chamber is applied to the pressure generating device to inflate the liquid chamber, so that the ink overflowing from the nozzle is drawn into the nozzle.

Therefore, the ink 202 remaining on the degraded repellent film 200 has a long draw-in time and moves slowly. For this reason, the meniscus can be drawn into the nozzle with no ink 202 remaining on the degraded repellent film (refer to FIG. 10A). Thereafter, when the ink 202 is discharged by the rise-up waveform element (waveform element to contract the liquid chamber) (refer to FIG. 11B) from this state, no deviation of liquid droplets occurs (refer to FIG. 11A).

Figure 9A:
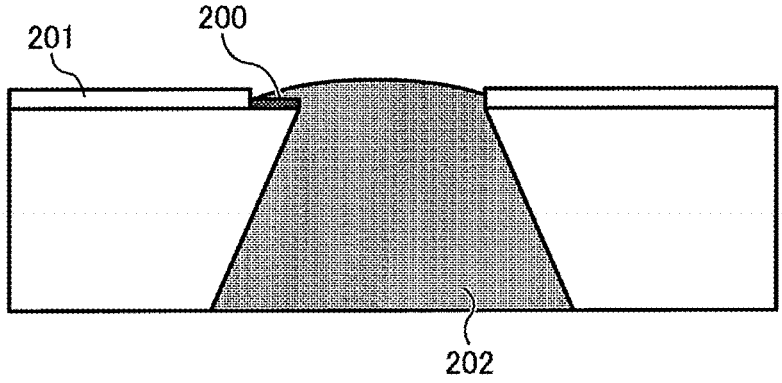
FIG. 9A is a schematic diagram illustrating a state in which an ink in a nozzle and the ink on a degraded repellent film are drawn in the nozzle together.
Figure 9B:
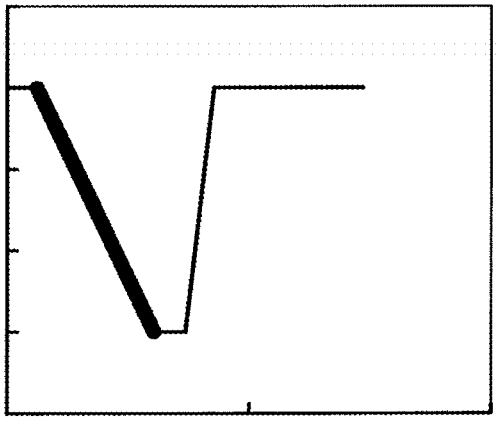
FIG. 9B is a graph illustrating a drive pulse in the state illustrated in FIG. 9A.
Figure 10A:
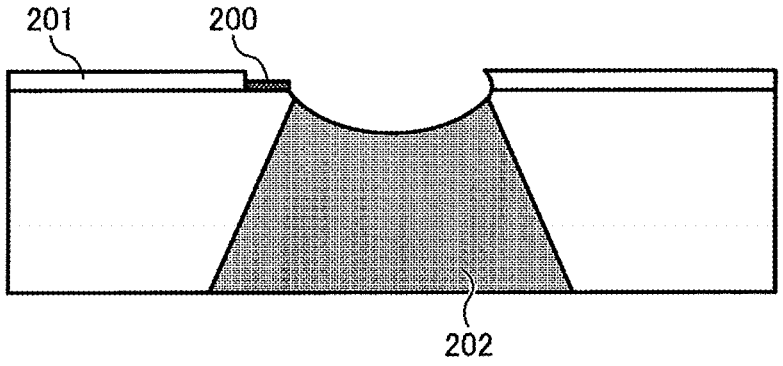
FIG. 10A is a schematic diagram illustrating a state in which the meniscus is drawn in the nozzle.
Figure 10B:
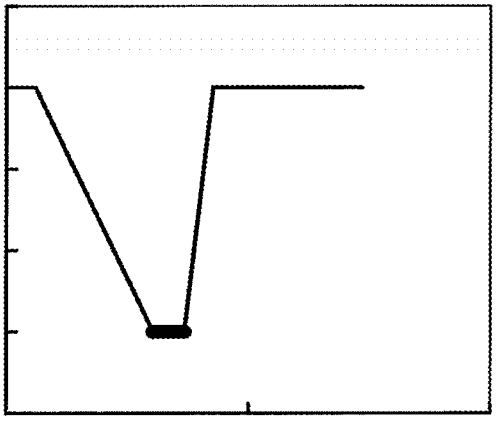
FIG. 10B is a graph illustrating a drive pulse in the state illustrated in FIG. 10A.
Figure 11A:
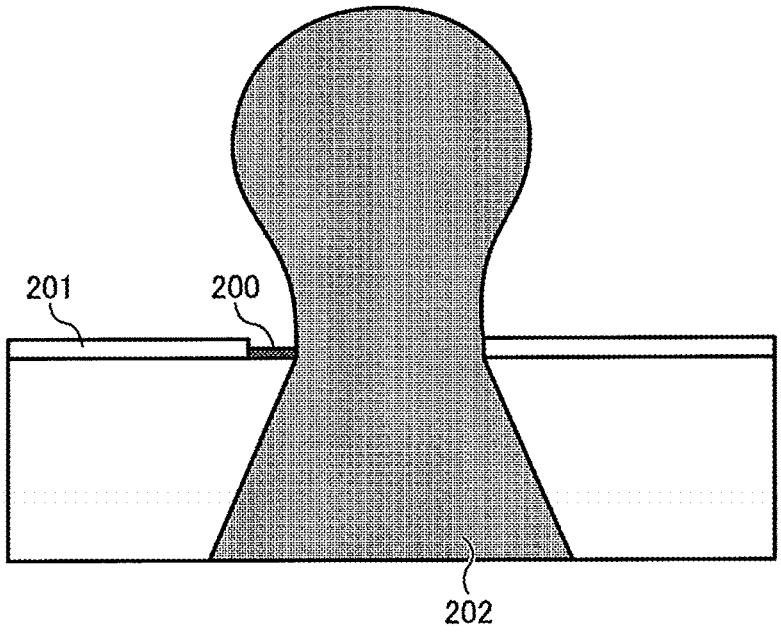
FIG. 11A is a schematic diagram illustrating a state in which the ink 202 is being discharged.
Figure 11B:
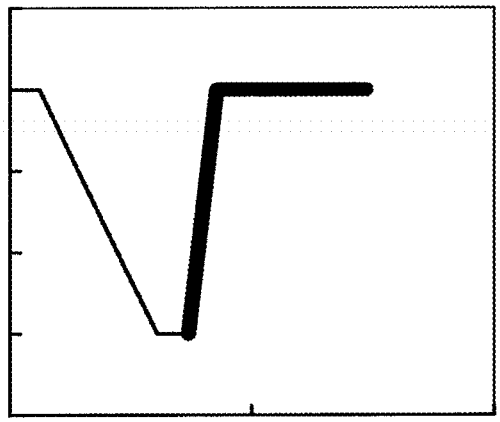
FIG. 11B is a graph illustrating a drive pulse in the state illustrated in FIG. 11A.

In the present specification, "pulse" also means a signal sharply changing in a short time. Also, each of the pulses illustrated in FIGS. 6B and 9B is a draw-in pulse.

In addition, when a typical discharging pulse is used for ink having a small difference between the static surface tension and the dynamic surface tension, the impact is small on discharging because the difference of the surface tension to the next liquid droplet is small. However, when the difference between the static surface tension and the dynamic surface tension is large, the surface tension of ink remaining on the surface of a nozzle sharply drops immediately after the surface of the nozzle becomes static, so that the difference of the surface tension between the remaining ink and the next discharging ink droplet increases. This causes non-uniformity of the surface tension when the remaining ink and the next droplet are united so that the surface texture of the liquid droplet collapses, leading to deviation of discharging.

The ink for use in the present disclosure has a dynamic surface tension 10 mN/m or more greater than the static surface tension when the surface life length is 15 ms and 3 mN/m or more greater than the static surface tension when the surface life length is 1,500 ms, as measured by maximum bubble pressure technique at 25 degrees C. In the case in which the difference between the static surface tension and the dynamic surface tension of ink is large, in particularly when the dynamic surface tension is within the range specified above, the impact of the remaining ink is strong. That impact is significant in the case of a large ink droplet.

The dynamic surface tension is a surface tension in a minute time length and can be typically measured by a maximum bubble pressure technique, a vibration jetting method, a meniscus method, a dripping method, etc. In the present disclosure, the maximum bubble pressure technique is used to measure dynamic surface tension easily in a short time.

The static surface tension of ink in the present disclosure is a value measured by a platinum plate method at 25 degrees C.

Figure 12:
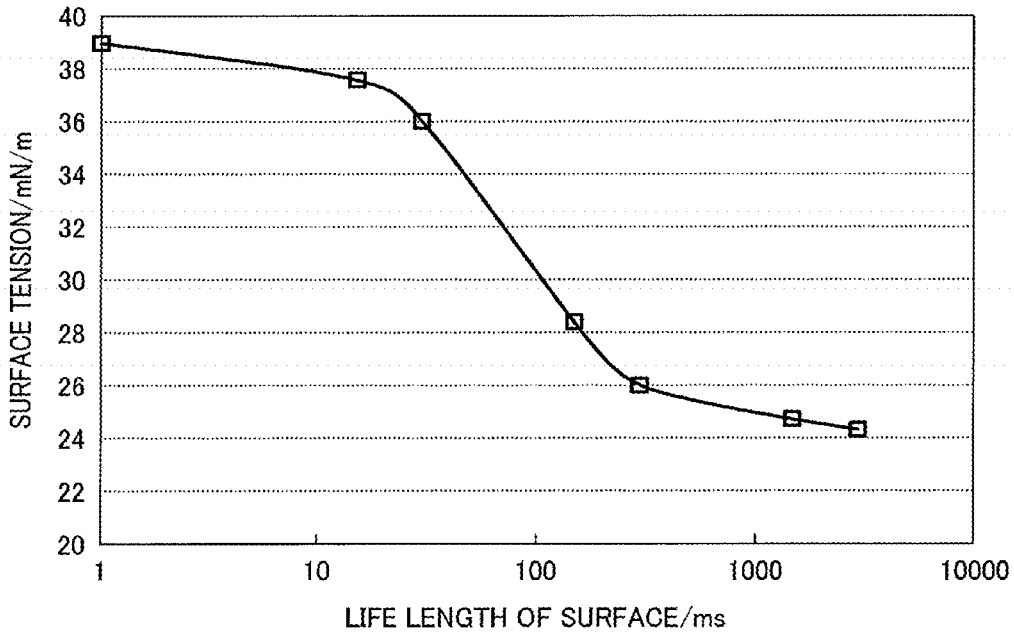
FIG. 12 is a graph illustrating dynamic surface tension to surface life length.

According to development of high performance printing technology, the printing speed by an inkjet printer is increasing year by year and have now reached several tens of meters/minute for continuous printing. To make this high performance possible, the ink meniscus at the surface of a nozzle of an inkjet printer vibrates in a frequency of $10^4$-$10^6$ Hz and ink droplets are formed in a similar frequency. Therefore, the dynamic surface tension at the time of ink discharging has to be measured in a minute time in the order of micro second. However, this is difficult. When looking at a profile of dynamic surface tension to the surface life length time, it monotonically increases and decreases to the surface life length time as illustrated in FIG. 12. Therefore, in the present disclosure, the dynamic surface tension at around 15 ms, which is close to measuring limit of maximum bubble pressure technique, is obtained and determined as the approximation value of dynamic surface tension of ink at actual discharging.

To the contrary, ink permeates into a recording medium after discharging in the order of at least milliseconds, which relates to bleed. Therefore, dynamic surface tension and static surface tension having a surface life length of 1,000 ms or more have an impact on image quality. For this reason, the present disclosure focuses on dynamic surface tension at around 1,500 ms.

According to the present disclosure, an inflation waveform element (voltage changing portion to draw in ink) of the voltage changing time having one third or more of the resonance period of a liquid chamber is applied to slowly draw the meniscus into the nozzle. Therefore, even the remnant of the ink, which has wet-spread far away from the nozzle orifice and cannot be drawn-in by an inflation waveform element in a short time, can be drawn-in into the meniscus in such a long drawing-in time. Therefore, the overflown ink is almost all retrieved and the impact on discharging due to the overflown ink is substantially canceled. As a result, quality images can be obtained. Slow drawing-in of a meniscus into a nozzle is advantageous to suppress vibration of large droplets in comparison with drawing-in of a meniscus in separate occasions. In the case of large droplets, the number of pulses in a single print cycle tends to be large and remaining vibration tends to be strong. To suppress this, it is extremely good to slowly draw a meniscus into a nozzle.

According to the present disclosure, when the inflation waveform element (voltage changing portion to draw in ink) is set to have a voltage changing time of one third or more of the resonance period of the liquid chamber of a head, meniscus is stably formed and discharging is stabilized at the same time.

It is preferably ⅓ to 1/1 of the resonance period of the liquid chamber in a head and particularly preferably 1/1 of the resonance period of the liquid chamber in a head.

The preferable reason why the voltage changing time of the inflation waveform element (voltage changing portion to draw in ink) is set as above is that when it is equal to one forth of the acoustic resonance period of the liquid chamber in a head, the phase of the remaining vibration of the discharging pulse just before and the phase of the pressure wave of the inflation waveform element are reverse, thereby suppressing overlapping of the two pressure waves. For this reason, the next discharging pulse fails to discharge the ink at required discharging speed. As the voltage changing time of the inflation waveform element becomes longer than ¼ of the acoustic resonance period of the liquid chamber in a head, the degree of superimposition is improved. If the voltage changing time is not less than ⅓, the overlapping state is good.

Due to the inflation waveform element, ink in the vicinity of the nozzle discharging orifice is drawn into a nozzle and a meniscus is formed at a predetermined position.

"Vicinity" means periphery of a nozzle orifice.

"Predetermined position" at the time when a meniscus is formed means a regular position where the meniscus is formed. For the cross-section of the orifice of the nozzle plate, a meniscus is formed at a position of a state forming a concave portion as to the reference surface of the nozzle plate. In the present disclosure, a meniscus is not formed at a regular position when the meniscus overflowing occurs.

According to the present disclosure, an inkjet recording method is provided which is capable of stably discharging ink having a large difference between the dynamic surface tension and the static surface tension and producing images with high quality. This is significant when a repellent film on a nozzle plate has degraded.

According to the present disclosure, one or more drive pulse is applied to a pressure generating device in a single print cycle to discharge one or more droplets of ink. It is preferable that, in the drive pulse forming the first droplet thereof, the voltage changing time of the inflation waveform element (voltage changing portion to draw in ink) be one third or more of the resonance period of the liquid chamber.

"Single print cycle" means, for example, a time interval during which each actuator forms each dot on a medium.

"Single print cycle" includes the discharging pulse (drive pulse).

"Single print cycle" is described in detail in Unexamined Japanese Patent Application Publication No. 2001-146011, Unexamined Japanese Patent Application Publication No. H10-81012, Unexamined Japanese Patent Application Publication No. 2011-062821, etc.

For example, an inkjet recording device is disclosed in Unexamined Japanese Patent Application Publication No. 2011-062821. The inkjet recording device discharges multiple ink droplets from each nozzle of an inkjet head in a single print cycle for forming a single dot on a recording medium to form the single dot by the multiple ink droplets.

The inkjet recording device includes a liquid chamber to accommodate ink, a nozzle plate having nozzles communicating with the liquid chamber, an inkjet head having an actuator (pressure generating device) to apply a pressure to the ink in the liquid chamber in order to discharge droplets of the ink through the nozzle due to the piezoelectric effect of a piezoelectric element, a drive waveform generating unit to generate a drive waveform including a drive pulse, a head driver to select the drive pulse from the drive waveform to generate a discharging pulse and apply the discharging pulse to the actuator, and a relatively moving device to relatively move the inkjet head from a recording medium.

Figure 21:
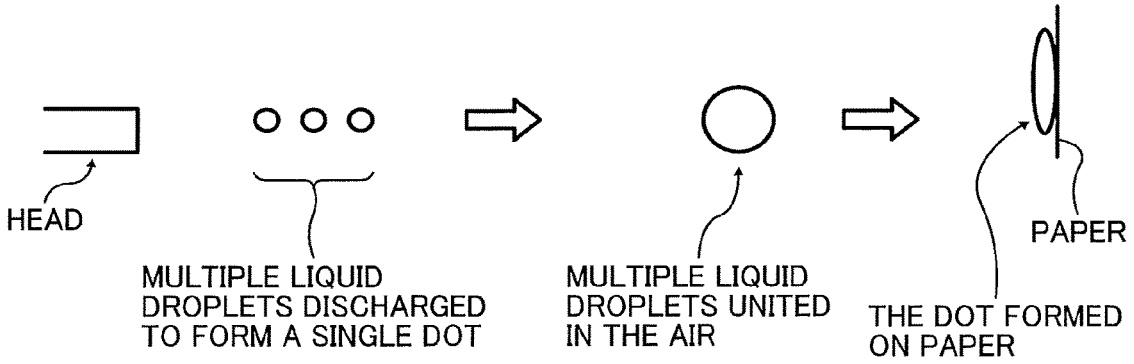
FIG. 21 is a diagram illustrating a single print cycle.

As illustrated in FIG. 21, when the relatively moving device moves the inkjet head and the recording medium relatively from each other, a single or multiple drive pulses (discharging pulses) are supplied to the actuator in the single print cycle to discharge a single or multiple ink droplet.

The multiple ink droplets discharged form a single ink dot on the recording medium.

Such dots are disposed on the recording medium so that a predetermined image is formed thereon.

When the number of ink droplets discharged in the single print cycle is adjusted, the gradation and the size of dots are adjusted, which makes it possible to conduct so-called multi-grade printing.

In the present disclosure, it is possible to have any of a configuration in which after the droplets contained in the single print cycle are united in the air, the united droplets are attached to a recording medium, another configuration in which the droplets contained in the single print cycle are attached to a recording medium according to the sequence of the discharging sequence, or yet another configuration in which only a single droplet is attached. Of these, the configuration in which after the droplets contained in the single print cycle are united in the air, the united droplets are attached to a recording medium is preferable in terms that the form of ink is close to a circle and the ink droplet does not deviate from the position where the droplets should be attached.

At this point in time, if the inflation waveform element (voltage changing portion to draw in ink) of the discharging pulse (drive pulse) to form the first droplet is set to be the long voltage changing time described above, the remnant of ink accumulating on the nozzle plate is retrieved and the meniscus of the first droplet is formed evenly. Also, it is possible to cancel the impact on meniscus formation by the second droplet and the later droplets (in the same single print cycle) formed immediately after the first droplet. The reason why the inflation waveform element having the long voltage changing time described above is applied is that the discharging pulse forming the first droplet is sufficient to obtain the effect. It is also possible to enter a particular inflation waveform element for the discharging pulses for the second droplet and the droplets thereafter. However, taking slow drawing-in a meniscus into account, the velocity of the waveform is not earned, which makes entering the particular waveform not practical.

Ink

The dynamic surface tension of the ink is 10 mN/m or more greater than the static surface tension of the ink when the surface life length is 15 ms and 3 mN/m or more greater than the static surface tension of the ink when the surface life length is 1,500 ms, as measured by maximum bubble pressure technique at 25 degrees C.

As described before, having a large difference between the static surface tension and the dynamic surface tension contributes to prevention of bleed of the ink on a recording medium and discharging stability.

The dynamic surface tension can be measured by, for example, a maximum bubble pressure technique using a dynamic surface tensiometer (SITA DynoTester, manufactured by SITA Messtechnik GmbH).

Static surface tension can be measured at 25 degrees C. by a platinum plate method using a fully-automatic surface tensiometer (CBVP-Z, manufactured by Kyowa Interface Science Co., Ltd.).

There is no specific limitation to make the surface tension of the ink within the range specified above and such a method can be suitably selected to suit to a particular application. For example, it is possible to adjust the surface tension by the selection of the addition amount of a surfactant and a permeating agent of ink, the kind of surfactant, etc.

The ink includes, for example, an organic solvent, water, a coloring material, a surfactant, and other optional components based on a necessity basis.

The organic solvent is added to prevent drying of ink and improve dispersion stability thereof. In addition, the organic solvent in the present disclosure includes articles classified as permeating agent or defoaming agent in terms of functionality.

As the water, deionized water, ultrafiltered water, reverse osmosis water, pure water such as distilled water, and ultra pure water can be used.

As to the surfactant, it is preferable to select a surfactant that has a low surface tension, a high permeability, and an excellent leveling property without degrading dispersion stability of the coloring agent irrespective of the kind of the coloring agent and the combinational use with the organic solvent, etc.

Those ink components are furthermore described.

Organic Solvent

There is no specific limitation on the type of the organic solvent used in the present disclosure. For example, water-soluble organic solvents are suitable. Specific examples include, but are not limited to, polyols, ethers such as polyol alkylethers and polyol arylethers, nitrogen-containing heterocyclic compounds, amides, amines, and sulfur-containing compounds.

Specific examples of the water-soluble organic solvents include, but are not limited to, polyols such as ethylene glycol, diethylene glycol, 1,2-propanediol, 1,3-propanediol, 1,2-butanediol, 1,3-butanediol, 1,4-butanediol, 2,3-butanediol, 3-methyl-1,3-butane diol, triethylene glycol, polyethylene glycol, polypropylene glycol, 1,2-pentanediol, 1,3-pentanediol, 1,4-pentanediol, 2,4-pentanediol, 1,5-pentanediol, 1,2-hexanediol, 1,6-hexanediol, 1,3-hexanediol, 2,5-hexanediol, 1,5-hexanediol, glycerin, 1,2,6-hexanetriol, 2-ethyl-1,3-hexanediol, ethyl-1,2,4-butane triol, 1,2,3-butanetriol, 2,2,4-trimethyl-1,3-pentanediol, and petriol; polyol alkylethers such as ethylene glycol monoethylether, ethylene glycol monobutylether, diethylene glycol monomethylether, diethylene glycol monoethylether, diethylene glycol monobutylether, tetraethylene glycol monomethylether, and propylene glycol monoethylether; polyol arylethers such as ethylene glycol monophenylether and ethylene glycol monobenzylether; nitrogen-containing heterocyclic compounds such as 2-pyrolidone, N-methyl-2-pyrolidone, N-hydroxyethyl-2-pyrolidone, 1,3-dimethyl-2-imidazolidinone, ϵ-caprolactam, and γ-butyrolactone; amides such as formamide, N-methylformamide, N,N-dimethylformamide, 3-methoxy-N,N-dimethyl propioneamide, and 3-buthoxy-N,N-dimethyl propioneamide; amines such as monoethanolamine, diethanolamine, and triethylamine; sulfur-containing compounds such as dimethyl sulfoxide, sulfolane, and thiodiethanol; propylene carbonate, and ethylene carbonate.

Since the organic solvent serves as a humectant and also imparts a good drying property, it is preferable to use an organic solvent having a boiling point of 250 degrees C. or lower.

Polyol compounds having eight or more carbon atoms and glycol ether compounds are also suitable.

Specific examples of the polyol compounds having eight or more carbon atoms include, but are not limited to, 2-ethyl-1,3-hexanediol and 2,2,4-trimethyl-1,3-pentanediol.

Specific examples of the glycolether compounds include, but are not limited to, polyol alkylethers such as ethyleneglycol monoethylether, ethyleneglycol monobutylether, diethylene glycol monomethylether, diethyleneglycol monoethylether, diethyleneglycol monobutylether, tetraethyleneglycol monomethylether, propyleneglycol monoethylether; and polyol aryl ethers such as ethyleneglycol monophenylether and ethyleneglycol monobenzylether.

The polyol compounds having eight or more carbon atoms and glycolether compounds enhance permeability of ink when paper is used as a print medium (recording medium).

The proportion of the organic solvent in ink has no particular limit and can be suitably selected to suit a particular application. In terms of the drying property and discharging reliability of the ink, the proportion is preferably 10-60 percent by mass and more preferably 20-60 percent by mass.

Water

The proportion of water in the ink has no particular limit. In terms of the drying property and discharging reliability of the ink, the proportion is preferably 10-90 percent by mass and more preferably 20-60 percent by mass.

Coloring Material

The coloring material has no particular limit. For example, pigments and dyes are suitable.

The pigment includes inorganic pigments and organic pigments. These can be used alone or in combination. In addition, it is possible to use a mixed crystal.

As the pigments, for example, black pigments, yellow pigments, magenta pigments, cyan pigments, white pigments, green pigments, orange pigments, gloss pigments of gold, silver, etc., and metallic pigments can be used.

As the inorganic pigments, in addition to titanium oxide, iron oxide, calcium oxide, barium sulfate, aluminum hydroxide, barium yellow, cadmium red, and chrome yellow, carbon black manufactured by known methods such as contact methods, furnace methods, and thermal methods can be used.

As the organic pigments, it is possible to use azo pigments, polycyclic pigments (phthalocyanine pigments, perylene pigments, perinone pigments, anthraquinone pigments, quinacridone pigments, dioxazine pigments, indigo pigments, thioindigo pigments, isoindolinone pigments, and quinophthalone pigments, etc.), dye chelates (basic dye type chelates, acid dye type chelates, etc.), nitro pigments, nitroso pigments, and aniline black can be used. Of these pigments, pigments having good affinity with solvents are preferable. Also, hollow resin particles and hollow inorganic particles can be used.

Specific examples of the pigments for black include, but are not limited to, carbon black (C.I. Pigment Black 7) such as furnace black, lamp black, acetylene black, and channel black, metals such as copper, iron (C.I. Pigment Black 11), and titanium oxide, and organic pigments such as aniline black (C.I. Pigment Black 1).

Specific examples of the pigments for color include, but are not limited to, C.I. Pigment Yellow 1, 3, 12, 13, 14, 17, 24, 34, 35, 37, 42 (yellow iron oxide), 53, 55, 74, 81, 83, 95, 97, 98, 100, 101, 104, 108, 109, 110, 117, 120, 138, 150, 153, 155, 180, 185, and 213; C.I. Pigment Orange 5, 13, 16, 17, 36, 43, and 51; C.I. Pigment Red 1, 2, 3, 5, 17, 22, 23, 31, 38, 48:2, 48:2 {Permanent Red 2B(Ca)}, 48:3, 48:4, 49:1, 52:2, 53:1, 57:1 (Brilliant Carmine 6B), 60:1, 63:1, 63:2, 64:1, 81, 83, 88, 101 (rouge), 104, 105, 106, 108 (Cadmium Red), 112, 114, 122 (Quinacridone Magenta), 123, 146, 149, 166, 168, 170, 172, 177, 178, 179, 184, 185, 190, 193, 202, 207, 208, 209, 213, 219, 224, 254, and 264; C.I. Pigment Violet 1 (Rhodamine Lake), 3, 5:1, 16, 19, 23, and 38; C.I. Pigment Blue 1, 2, 15 (Phthalocyanine Blue), 15:1, 15:2, 15:3, 15:4, (Phthalocyanine Blue), 16, 17:1, 56, 60, and 63; C.I. Pigment Green 1, 4, 7, 8, 10, 17, 18, and 36.

The type of dye is not particularly limited and includes, for example, acidic dyes, direct dyes, reactive dyes, basic dyes. These can be used alone or in combination.

Specific examples of the dye include, but are not limited to, C.I. Acid Yellow 17, 23, 42, 44, 79, and 142, C.I. Acid Red 52, 80, 82, 249, 254, and 289, C.I. Acid Blue 9, 45, and 249, C.I. Acid Black 1, 2, 24, and 94, C. I. Food Black 1 and 2, C.I. Direct Yellow 1, 12, 24, 33, 50, 55, 58, 86, 132, 142, 144, and 173, C.I. Direct Red 1, 4, 9, 80, 81, 225, and 227, C.I. Direct Blue 1, 2, 15, 71, 86, 87, 98, 165, 199, and 202, C.I. Direct Black 19, 38, 51, 71, 154, 168, 171, and 195, C.I. Reactive Red 14, 32, 55, 79, and 249, and C.I. Reactive Black 3, 4, and 35.

The proportion of the coloring material in the ink is preferably 0.1-15 percent by mass and more preferably 1-10 percent by mass in terms of enhancement of image density, fixability, and discharging stability.

To disperse a pigment in the ink, for example, a hydrophilic functional group is introduced into the pigment to prepare a self-dispersible pigment, the surface of the pigment is coated with a resin, or a dispersant is used to disperse the pigment.

As a method of introducing a hydrophilic functional group into a pigment to prepare a self-dispersible pigment, it is possible to use, for example, a self-dispersion pigment, etc. in which a functional group such as a sulfone group and a carboxyl group is added to a pigment (e.g., carbon) to make it dispersible in water.

To coat the surface of the pigment with a resin, the pigment is encapsulated by microcapsules to make the pigment dispersible in water. This can be referred to as a resin-coated pigment. In this case, all the pigments to be added to ink are not necessarily coated with a resin. Pigments partially or wholly uncovered with a resin may be dispersed in the ink unless the pigments have an adverse impact.

In a method of using a dispersant to disperse a pigment, for example, a known dispersant of a small molecular weight or a large molecular weight, which is represented by a surfactant, is used to disperse the pigment in ink.

As the dispersant, it is possible to select, for example, an anionic surfactant, a cationic surfactant, a nonionic surfactant, an amphoteric surfactant, etc. depending on a pigment.

Also, a nonionic surfactant (RT-100, manufactured by TAKEMOTO OIL & FAT CO LTD.) and a formalin condensate of naphthalene sodium sulfonate are suitable as the dispersant.

Those can be used alone or in combination.

Pigment Dispersion

A coloring material may be mixed with materials such as water and an organic solvent to obtain ink. It is also possible to mix a pigment with water, a dispersant, etc., first to prepare a pigment dispersion and thereafter mix the pigment dispersion with materials such as water and organic solvent to manufacture ink.

The pigment dispersion can be obtained by dispersing water, a pigment, a pigment dispersant, and other optional components and adjusting the particle size. It is good to use a dispersing device for dispersion.

The particle diameter of the pigment in the pigment dispersion has no particular limit. For example, the maximum frequency in the maximum number conversion is preferably from 20 to 500 nm and more preferably from 20 to 150 nm to improve dispersion stability of the pigment and ameliorate the discharging stability and image quality such as image density. The particle diameter of the pigment can be measured using a particle size analyzer (Nanotrac Wave-UT151, manufactured by MicrotracBEL Corp).

In addition, the proportion of the pigment in the pigment dispersion is not particularly limited and can be suitably selected to suit a particular application. In terms of improving discharging stability and image density, the proportion is preferably 0.1-50 percent by mass and more preferably 0.1-30 percent by mass.

It is preferable that the pigment dispersion be filtered with a filter, a centrifuge, etc. to remove coarse particles and thereafter degassed.

The ink for use in the present disclosure may include polymer particulates containing a hydrophobic dye or pigment as the colorant to improve print density and print durability. The polymer particulate is used as a dispersion. Of these, dispersions of the polymer particulate including a pigment, in particular an organic pigment or carbon black are more preferable. Specific examples of the polymer for use in the dispersion of the polymer particulate containing the pigment include, but are not limited to, vinyl-based polymers, polyester-based polymers, and polyurethane-based polymers. Of these, vinyl-based polymers are preferable.

Polymers obtained by co-polymerizing a monomer composition including (a): at least one kind of vinyl-based monomer selected from the group consisting of acrylic acid esters, methacrylic acid esters, and styrene-based monomers, (b): a polymerizable unsaturated monomer having a salt-producing group, and (c): a component copolymerizable with the vinyl-based monomer and the polymerizable unsaturated monomer having a salt-producing group are preferable as the vinyl-based polymer.

As the vinyl-based monomer of (a), specific examples include, but are not limited to, acrylic acid esters such as methylacrylate, ethylacrylate, isopropylacrylate, n-butylacrylate, t-butylacrylate, isobutylacrylate, n-amylacrylate, n-hexylacrylate, n-octylacrylate, t-butyln-octylacrylate, isobutylacrylate, n-amylacrylate, n-hexylacrylate, n-octylacrylate, and dodecylacrylate; methacrylic acid esters such as methylmethactylate, isopropylmethactylate, n-butylmethactylate, t-butylmethactylate, isobutylmethactylate, n-amylmethactylate, 2-ethylhexylmethactylate, and laurylmethactylate; and styrene-based monomers such as styrene, vinyltoluene, and 2-methylstyrene. These can be used alone or in combination.

As the polymerizable unsaturated monomer having a salt-producing group of (b), examples thereof are cationic monomers having a salt-producing group and anionic monomers having a salt-producing group.

As the cationic monomers having a salt-producing group, examples thereof are tertiary amine-containing unsaturated monomers and ammonium salt-containing unsaturated monomers. Preferred specific examples thereof include, but are not limited to, N,N-diethylaminoethylacrylate, N—(N',N'-dimethylaminoethyl)acrylamide, vinyl pyridine, 2-methyl-5-vinylpyridine, dimethylaminoethyl methacrylate, and diethylaminoethyl methacrylate.

As the anionic monomer having the salt-producing group, examples thereof are unsaturated carboxylic acid monomers, unsaturated sulfonic acid monomers, and unsaturated phosphoric acid monomers. Specific examples of the anionic monomer having the salt-producing group include, but are not limited to, acrylic acid, methacrylic acid, itaconic acid, fumaric acid, and maleic acid.

As the component copolymerizable with the vinyl-based monomer and the polymerizable unsaturated monomer including a salt producing group of (c), examples thereof are acrylamide-based monomers, methacrylamide-based monomers, hydroxyl group including monomers, and macromers having polymerizable functional groups at one end.

The macromer having a polymerizable functional group at one end has no particular limit and suitably selected to suit to a particular application. Examples thereof are silicone macromers, styrene-based macromers, polyester-based macromers, polyurethane-based macromers, polyalkyl ether macromers, and macromers represented by the chemical formula: $CH_2{=}C(R^5)COO(R^6O)_pR^7$ (in the chemical formula, $R^5$ represents a hydrogen atom or a lower alkyl group, $R^6$ represents a divalent hydrocarbon group having 1 to 30 carbon atoms allowed to have a hetero atom, $R^7$ is a monovalent hydrocarbon group having 1 to 30 carbon atoms allowed to have a hydrogen atom or hetero atom, and p represents an integer of from 1 to 60). These can be used alone or in combination.

Specific examples of the lower alkyl group in the Chemical formula include, but are not limited to, alkyl groups having one to four carbon atoms.

Specific examples of the hydroxyl group containing monomer include, but are not limited to, 2-hydroxyethyl acrylate and 2-hydroxyethyl methacrylate.

The macromer represented by the chemical formula $CH_2{=}C(R^5)COO(R^6O)_pR^7$ are preferably polyethylene glycol (meth)acrylate (2 to 30 carbon atoms) and methoxypolyethylene glycol (meth)acrylate (1 to 30 carbon atoms). In the present disclosure, (meth)acrylate represents acrylate or methacrylate.

Of the copolymerizable component, the macromer is preferable. Silicone macromers, styrene-based macromers, and polyalkylether macromers are preferable.

There is no specific limitation to the proportion of the vinyl-based monomer in the monomer composition and it can be suitably selected to suit to a particular application. It is preferably 1-75 percent by mass, more preferably 5-60 percent by mass, and furthermore preferably 10-50 percent by mass to improve the dispersion stability of a polymer emulsion.

There is no specific limitation to the proportion of the polymerizable unsaturated monomer having a salt-producing group in the monomer composition and it can be suitably selected to suit to a particular application. For example, it is preferably 2-40 percent by mass and more preferably 5-20 percent by mass to improve the dispersion stability of a polymer emulsion.

There is no specific limitation to the proportion of the vinyl-based monomer and the polymerizable unsaturated monomer having a salt-producing group in the monomer composition and it can be suitably selected to suit to a particular application. It is preferably 5-90 percent by mass, more preferably 10-85 percent by mass, and particularly preferably 20-60 percent by mass to improve the dispersion stability of a polymer emulsion.

The proportion of the polymer particulate is preferably 10-40 percent by mass to the total prescription of ink.

The average particle diameter of the polymer particulate is preferably 20-200 nm in terms of dispersion stability.

The average particle diameter is, for example, the 50 percent average particle diameter (D50) obtained by measuring at 23 degrees C. a sample prepared by dilution with a pure water in such a manner that the concentration of the pigment in the measuring sample is 0.01 percent by mass by using Microtrac UPA-150 (manufactured by Nikkiso Co., Ltd.) with a particle refractive index of 1.51, a particle density of 1.4 g/cm$^3$, and pure water parameters as the solvent parameter.

Surfactant

Examples of the surfactant are silicone-based surfactants, fluorochemical surfactants, amphoteric surfactants, nonionic surfactants, anionic surfactants, etc.

The silicone-based surfactant has no specific limit and can be suitably selected to suit to a particular application.

Of these, preferred are silicone-based surfactants which are not decomposed even in a high pH environment. Specific examples thereof include, but are not limited to, side-chain-modified polydimethylsiloxane, both-distal end-modified polydimethylsiloxane, one-distal-end-modified polydimethylsiloxane, and side-chain-both-distal-end-modified polydimethylsiloxane. A silicone-based surfactant having a polyoxyethylene group or a polyoxyethylene polyoxypropylene group is particularly preferable because such an agent demonstrates good characteristics as an aqueous surfactant. It is possible to use a polyether-modified silicone-based surfactant as the silicone-based surfactant. An example is a compound in which a polyalkylene oxide structure is introduced into the side chain of the Si site of dimethyl siloxane.

Specific examples of the fluorochemical surfactants include, but are not limited to, perfluoroalkyl sulfonic acid compounds, perfluoroalkyl carboxylic acid compounds, ester compounds of perfluoroalkyl phosphoric acid, adducts of perfluoroalkyl ethylene oxide, and polyoxyalkylene ether polymer compounds having a perfluoroalkyl ether group in its side chain. These are particularly preferable because they do not easily produce foams.

Specific examples of the perfluoroalkyl sulfonic acid compounds include, but are not limited to, perfluoroalkyl sulfonic acid and salts of perfluoroalkyl sulfonic acid.

Specific examples of the perfluoroalkyl carboxylic acid compounds include, but are not limited to, perfluoroalkyl carboxylic acid and salts of perfluoroalkyl carboxylic acid.

Specific examples of the polyoxyalkylene ether polymer compounds having a perfluoroalkyl ether group in its side chain include, but are not limited to, salts of sulfuric acid ester of polyoxyalkylene ether polymer having a perfluoroalkyl ether group in its side chain and salts of polyoxyalkylene ether polymers having a perfluoroalkyl ether group in its side chain. Counter ions of salts in these fluorochemical surfactants are, for example, Li, Na, K, $NH_4$, $NH_3CH_2CH_2OH$, $NH_2(CH_2CH_2OH)_2$, and $NH(CH_2CH_2OH)_3$.

Specific examples of the amphoteric surfactants include, but are not limited to, lauryl aminopropionic acid salts, lauryl dimethyl betaine, stearyl dimethyl betaine, and lauryl dihydroxyethyl betaine.

Specific examples of the nonionic surfactants include, but are not limited to, polyoxyethylene alkyl phenyl ethers, polyoxyethylene alkyl esters, polyoxyethylene alkyl amines, polyoxyethylene alkyl amides, polyoxyethylene propylene block polymers, sorbitan aliphatic acid esters, polyoxyethylene sorbitan aliphatic acid esters, and adducts of acetylene alcohol with ethylene oxides.

Specific examples of the anionic surfactants include, but are not limited to, polyoxyethylene alkyl ether acetates, dodecyl benzene sulfonates, laurates, and polyoxyethylene alkyl ether sulfates.

These can be used alone or in combination.

The silicone-based surfactants has no particular limit and can be suitably selected to suit to a particular application. Specific examples thereof include, but are not limited to, side-chain-modified polydimethyl siloxane, both distal-end-modified polydimethylsiloxane, one-distal-end-modified polydimethylsiloxane, and side-chain-both-distal-end-modified polydimethylsiloxane. In particular, a polyether-modified silicone-based surfactant having a polyoxyethylene group or a polyoxyethylene polyoxypropylene group is particularly preferable because such a surfactant demonstrates good characteristics as an aqueous surfactant.

Any suitably synthesized surfactant and any product thereof available on the market is suitable. Products available on the market can be obtained from Byc Chemie Japan Co., Ltd., Shin-Etsu Silicone Co., Ltd., Dow Corning Toray Co., Ltd., etc., NIHON EMULSION Co., Ltd., Kyoeisha Chemical Co., Ltd., etc.

The polyether-modified silicon-containing surfactant has no particular limit and can be suitably selected to suit to a particular application. For example, a compound is usable in which the polyalkylene oxide structure represented by the following Chemical structure S-1 is introduced into the side chain of the Si site of dimethyl polysiloxane.

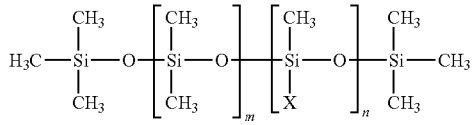

$X = —R(C_2H_4O)_a(C_3H_6O)_bR'$

In the Chemical formula S-1 illustrated above, m, n, a, and b independently represent integers. In addition, R and R' independently represent alkyl groups and alkylene groups.

Specific examples of polyether-modified silicone-based surfactants include, but are not limited to, KF-618, KF-642, and KF-643 (all manufactured by Shin-Etsu Chemical Co., Ltd.), EMALEX-SS-5602 and SS-1906EX (both manufactured by NIHON EMULSION Co., Ltd.), FZ-2105, FZ-2118, FZ-2154, FZ-2161, FZ-2162, FZ-2163, and FZ-2164 (all manufactured by Dow Corning Toray Co., Ltd.), BYK-33 and BYK-387 (both manufactured by BYK Japan KK.), and TSF4440, TSF4452, and TSF4453 (all manufactured by Momentive Performance Materials Inc.).

A fluorochemical surfactant in which the number of carbon atoms replaced with fluorine atoms is 2-16 is preferable and, 4 to 16, more preferable.

Specific examples of the fluorochemical surfactants include, but are not limited to, perfluoroalkyl phosphoric acid ester compounds, adducts of perfluoroalkyl ethylene oxide, and polyoxyalkylene ether polymer compounds having a perfluoroalkyl ether group in its side chain. Of these, polyoxyalkylene ether polymer compounds having a perfluoroalkyl ether group in its side chain are preferable because they do not foam easily and the fluorochemical surfactant represented by the following Chemical formula F-1 or Chemical formula F-2 is more preferable.

$$CF_3CF_2(CF_2CF_2)_m—CH_2CH_2O(CH_2CH_2O)_nH \quad \text{Chemical formula F-1}$$

In the Chemical formula F-1, "m" is preferably 0 or an integer of from 1 to 10 and "n" is preferably 0 or an integer of from 1 to 40.

$$C_nF_{-2n++1}—CH_2CH(OH)CH_2—O—(CH_2CH_2O)_a—Y \quad \text{Chemical formula F-2}$$

In the compound represented by the chemical formula F-2, Y represents H or $CnF_{2n+1}$, where n represents an integer of 1-6, or $CH_2CH(OH)CH_2—CnF_{2n+}+1$, where n represents an integer of 4-6, or $CpH_{2p+1}$, where p is an integer of 1-19, "a" represents an integer of from 4 to 14.

As the fluorochemical surfactant, products available on the market may be used. Specific examples of the products available on the market include, but are not limited to, SURFLON S-111, SURFLON S-112, SURFLON S-121, SURFLON S-131, SURFLON S-132, SURFLON S-141, and SURFLON S-145 (all manufactured by ASAHI GLASS CO., LTD.); FLUORAD FC-93, FC-95, FC-98, FC-129, FC-135, FC-170C, FC-430, and FC-431 (all manufactured by SUMITOMO 3M); MEGAFACE F-470, F-1405, and F-474 (all manufactured by DIC CORPORATION); ZONYL TBS, FSP, FSA, FSN-100, FSN, FSO-100, FSO, FS-300 UR (all manufactured by E. I. du Pont de Nemours and Company); FT-110, FT-250, FT-251, FT-400S, FT-150, and FT-400SW (all manufactured by NEOS COMPANY LIMITED); POLYFOX PF-136A, PF-156A, PF-151N, PF-154, and PF-159 (manufactured by OMNOVA SOLUTIONS INC.); and UNIDYNE™ DSN-403N (manufactured by DAIKIN INDUSTRIES, Ltd.). Among these, in terms of improvement on print quality, in particular coloring property and permeability, wettability, and uniform dying property on paper, FS-300 of E. I. du Pont de Nemours and Company, FT-110, FT-250, FT-251, FT-400S, FT-150, and FT-400SW of NEOS COMPANY LIMITED, POLYFOX PF-151N of OMNOVA SOLUTIONS INC., and UNIDYNE™ DSN-403N (manufactured by DAIKIN INDUSTRIES, Ltd.) are particularly preferable.

The proportion of the surfactant in the ink is not particularly limited and can be suitably selected to suit to a particular application. It is preferably 0.001-5 percent by mass and more preferably 0.05-5 percent by mass in terms of excellent wettability and discharging stability and improvement on image quality.

Other Components

The other optional components are not particularly limited and can be suitably selected to suit to a particular application. Examples thereof are a foam inhibitor (defoaming agent), a pH regulator, a preservatives and fungicides, a corrosion inhibitor, and a chelate reagent.

Foam Inhibitor (Defoaming Agent)

The foam inhibitor (defoaming agent) is added to prevent foaming of ink or break produced foams. An example of the foam inhibitor (defoaming agent) is represented by the following chemical formula 3.

$$HOR_1R_3C—(CH_2)_m—CR_2R_4OH \qquad \text{Chemical formula 3}$$

In the chemical formula 3, "$R_1$" and "$R_2$" each, independently represent alkyl groups having 3-6 carbon atoms. "$R_3$" and "$R_4$" each, independently represent alkyl groups having 1 to 2 carbon atoms. The symbol "m" represents an integer of 1-6.

Of the compounds represented by the chemical formula, 2,4,7,9-tetramethyl decane-4,7-diol is preferable because it demonstrates excellent foam suppressing property As the defoaming agent, silicone defoaming agent is preferable. Examples of the silicone defoaming agent are oil type silicone defoaming agent, compound type silicone defoaming agent, self-emulsification type silicone defoaming agent, emulsion type silicone defoaming agent, and modified silicone defoaming agent.

The defoaming agent is also available on the market.

Specific examples of the defoaming agent include, but are not limited to, silicone defoaming agent (KS508, KS531, KM72, KM72F, KM85, and KM98, manufactured by Shin-Etsu Chemical CO., LTD.), silicone defoaming agent (Q2-3183A, SH5500, SH5510, SM5571, SM5571 EMULSION, etc., manufactured by DOW CORNING TORAY CO., LTD.), silicone defoaming agents (SAG30, etc., manufactured by NIPPON UNICAR COMPANY LIMITED), and defoaming agents (ADEKANATE series, manufactured by ADEKA CORPORATION).

Preservatives and Fungicides

The preservatives and fungicides are not particularly limited. A specific example is 1,2-benzisothiazoline-3-on.

Corrosion Inhibitor

The corrosion inhibitor has not particular limitation. Examples thereof are acid sulfite and sodium thiosulfate.

pH Regulator

The pH regulator is added to keep ink alkali to stabilize the dispersion state and discharging of the ink. However, when pH is 11 or greater, the head of inkjet and an ink supplying unit tends to be dissolved easily, which results in modification, leakage, bad discharging performance of the ink, etc. over an extended period of use depending on the material forming the head or the unit. When the pigment is used as the colorant, it is more desirable to add a pH regulator when the pigment is mixed and kneaded and dispersed together with a dispersant in water than when additives such as a wetting agent and a permeating agent are added after mixing, kneading, and dispersing. This is because such dispersion may be broken depending on the kind of a pH regulator added.

The pH regulator is preferable to contain at least one of an alcohol amine, an alkali metal hydroxide, ammonium hydroxide, a phosphonium hydroxide, and an alkali metal carbonate.

Specific examples of the alcohol amines include, but are not limited to, diethanol amine, triethanol amine, and 2-amino-2-ethyl-1,3-propane diol.

Specific examples of the alkali metal hydroxides include, but are not limited to, lithium hydroxide, sodium hydroxide, and potassium hydroxide.

Specific examples of the hydroxides of ammonium include, but are not limited to, ammonium hydroxide and quaternary ammonium hydroxide.

A specific example of the phosphonium hydroxides is quaternary phosphonium hydroxide.

Specific examples of the alkali metal carbonates include, but are not limited to, lithium carbonate, sodium carbonate, and potassium carbonate.

Chelate Reagent

Specific examples of the chelate reagents include, but are not limited to, ethylene diamine sodium tetraacetate, nitrilo sodium triacetate, hydroxyethylethylene diamine sodium tri-acetate, sodium quinternary acetate, and uramil sodium diacetate.

The property of the ink is not particularly limited except for surface tension and can be suitably selected to suit to a particular application. For example, viscosity, surface tension, pH, etc, are preferable in the following ranges.

Viscosity of the ink at 25 degrees C. is preferably 3-30 mPa·s and more preferably 3-25 mPa·s to improve print density and text quality and obtain good dischargeability. Viscosity can be measured by, for example, a rotatory viscometer (RE-80L, manufactured by TOKI SANGYO CO., LTD.). The measuring conditions are as follows:

Standard cone rotor (1°34'×R24)

Sample liquid amount: 1.2 mL

Number of rotations: 50 rotations per minute (rpm)

25 degrees C.

Measuring time: three minutes

Viscosity of the ink can be adjusted by proportion and identification of each solvent and active agent and the content of water. There is no specific limitation to reducing viscosity and it can be suitably selected to suit to a particular application. For example, it is suitable to reduce the addition amount of the ink and increase the addition amount of water.

The pH of the ink is preferably 7-12 and more preferably 8-11 in terms of prevention of corrosion of metal materials including the ink.

Colorization

There is no specific limitation to the color of each ink for use in the present disclosure and it can be suitably selected to suit to a particular application. For example, yellow, magenta, cyan, and black can be used. When an ink set including at least two kinds of these inks is used for recording, multiple color images can be produced. When an ink set having all the colors is used, full color images can be formed.

Ink Set

In addition to the ink of a single color mentioned above, ink constituting an ink set including black ink and one or more color inks can be the ink for use in the inkjet recording method of the present disclosure. Each ink of the ink set preferably has a dynamic surface tension 10 mN/m or more greater than a static surface tension of the ink when the surface life length is 15 ms and 3 mN/m or more greater than the static surface tension of the ink when the surface life length is 1,500 ms, as measured by maximum bubble pressure technique at 25 degrees C. Moreover, each difference of the static surface tensions at 25 degrees C. obtained by subtracting the static surface tension of each of the one or more color inks from the static surface tension of the black ink is preferably 0-4 mN/m.

Static surface tension has an impact on the process of each ink in the ink set mentioned above permeating into a recording medium. Therefore, if a color image is formed by multiple kinds of inks having different colors and the difference in static surface tension of these values is different between each color, permeation state is different at the site where the inks having different colors contact, which leads to the degradation of the image quality.

In particular, since black color is easily visible, contours of fine lines and dots of black are clearly visible. Therefore, disturbance of an image tends to stand out. For example, if a dot of black ink having a high permeability, i.e., a low static surface tension is adjacent to a dot of another color ink having a low permeability, i.e., a high static surface tension, the black ink is drawn toward the color ink having a high static surface tension. For this reason, the black ink enters into the color ink, which makes the contour site unclear, which is referred to as bleed. This phenomenon tends to occur on a recording medium having a low permeability in particular, and also, this occurs at high performance printing during which permeation time is reduced.

To prevent this phenomenon, it is good to increase the static surface tension of the black ink and decrease the static surface tension of the other color ink. However, if the difference is excessively large, the other color ink enters into the black ink, making the text in black look thinner and causing bleed at the boundary site. Consequently, the image quality deteriorates.

If the static surface tension difference is small, bleed never or little occurs and the image quality is not substantially affected by contamination into the black ink having a low lightness. Therefore, in the present disclosure, the static surface tension of black ink is set to be equal to or at most 4 mN/m higher than the static surface tension of another color ink at 25 degrees C. so as to avoid this bleed issue.

According to the inkjet recording method of the present disclosure using the ink set mentioned above, even if the repellent film of a nozzle plate having nozzles constituting a liquid droplet discharging head is gradually degraded due to the physical burden ascribable to the maintenance operation to keep the surface of the nozzle plate clean, the liquid droplet discharging head is capable of stably continuing discharging the ink set containing black ink and at least one color ink with discharging stability (no streak on a solid portion, no dot missing, no deviation of discharging). In addition, the quality of an obtained image is good (uniformity at solid print site, no bleed between black ink and color ink).

Each ink of the ink set includes water, an organic solvent, a coloring material, and a surfactant. It may contain other optional components.

The water, the organic solvent, the coloring material, the surfactant, and the other optional component in each ink of the ink set can be the same as those for the ink described above.

As describe above, as the ink for use in the inkjet recording method of the present disclosure, an ink set including black ink and at least one color ink is used. Each ink of the ink set has a dynamic surface tension 10 mN/m or more greater than a static surface tension of the ink when the surface life length is 15 ms and 3 mN/m or more greater than the static surface tension of the ink when the surface life length is 1,500 ms, as measured by maximum bubble pressure technique at 25 degrees C. Moreover, each difference of the static surface tensions at 25 degrees C. obtained by subtracting the static surface tension of each of the one or more color inks from the static surface tension of the black ink is preferably 0-4 mN/m. If the static surface tension is too high, the ink slowly permeates into a medium, which causes beading or strike-through. To the contrary, if the static surface tension is too low, the ink permeates too soon to prevent strike-through.

To satisfy these conditions, the addition amount of each component can be adjusted. For example, to decrease the static surface tension, the following methods are suitable.

Increase the addition amount of a surfactant and a compound serving as a permeating agent of an organic solvent Use a surfactant having a strong power to reduce surface tension instead.

Decrease repellency of the repellent film on a nozzle plate.

Ink Container

The ink container for use in the present disclosure accommodates the ink or each ink of the ink set for use in the inkjet recording method of the present disclosure. Namely, the ink container is an article accommodating each ink therein and may optionally furthermore include other members.

There is no specific limitation to the container. Any form, any structure, any size, and any material can be suitably selected to suit to a particular application. For example, the container includes a plastic container or an ink accommodating unit formed of aluminum laminate film, etc.

Figure 22:
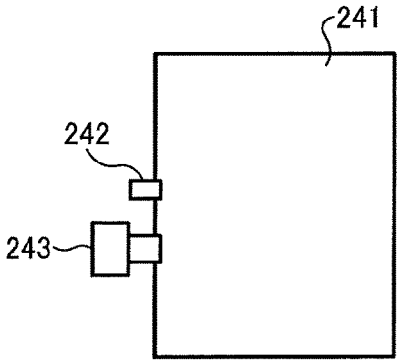
FIG. 22 is a schematic diagram illustrating an example of the ink container.
Figure 23:
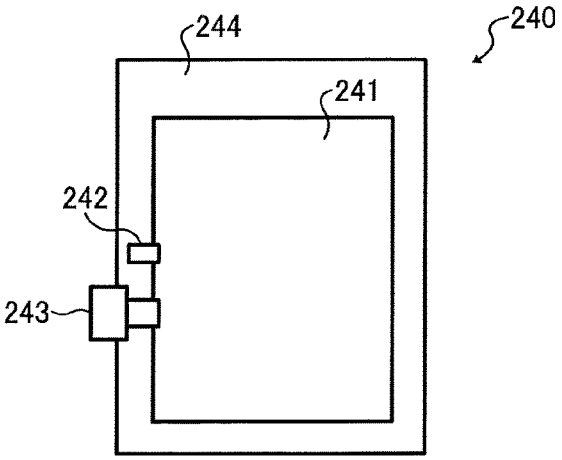
FIG. 23 is a schematic diagram illustrating the ink container illustrated in FIG. 22 including its housing.

Specific example thereof are illustrated in FIGS. 22 and 23. FIG. 22 is a diagram illustrating an example of the ink container. FIG. 23 is a diagram illustrating the ink container illustrated in FIG. 22 including the housing thereof.

An ink containing unit 241 is filled with the ink through an ink inlet 242. The air remaining in the ink accommodating unit 241 is discharged and thereafter the ink inlet 242 is closed by fusion. When in use, an ink outlet 243 made of rubber is pierced by the needle installed onto an inkjet recording device to supply the ink into the inkjet recording device. The ink accommodating unit 241 is made of a packaging material such as aluminum laminate film having no air permeability. As illustrated in FIG. 23, the ink accommodating unit 241 is typically housed in a housing 244 made of plastic and detachably attachable to various inkjet recording devices as an ink container 240.

This ink container accommodates the ink or each ink of the ink set and can be detachably attached to various inkjet recording devices, in particular the inkjet recording device described later.

Next, the inkjet recording method and the inkjet recording device of the present disclosure are described with reference to drawings.

Figure 13:
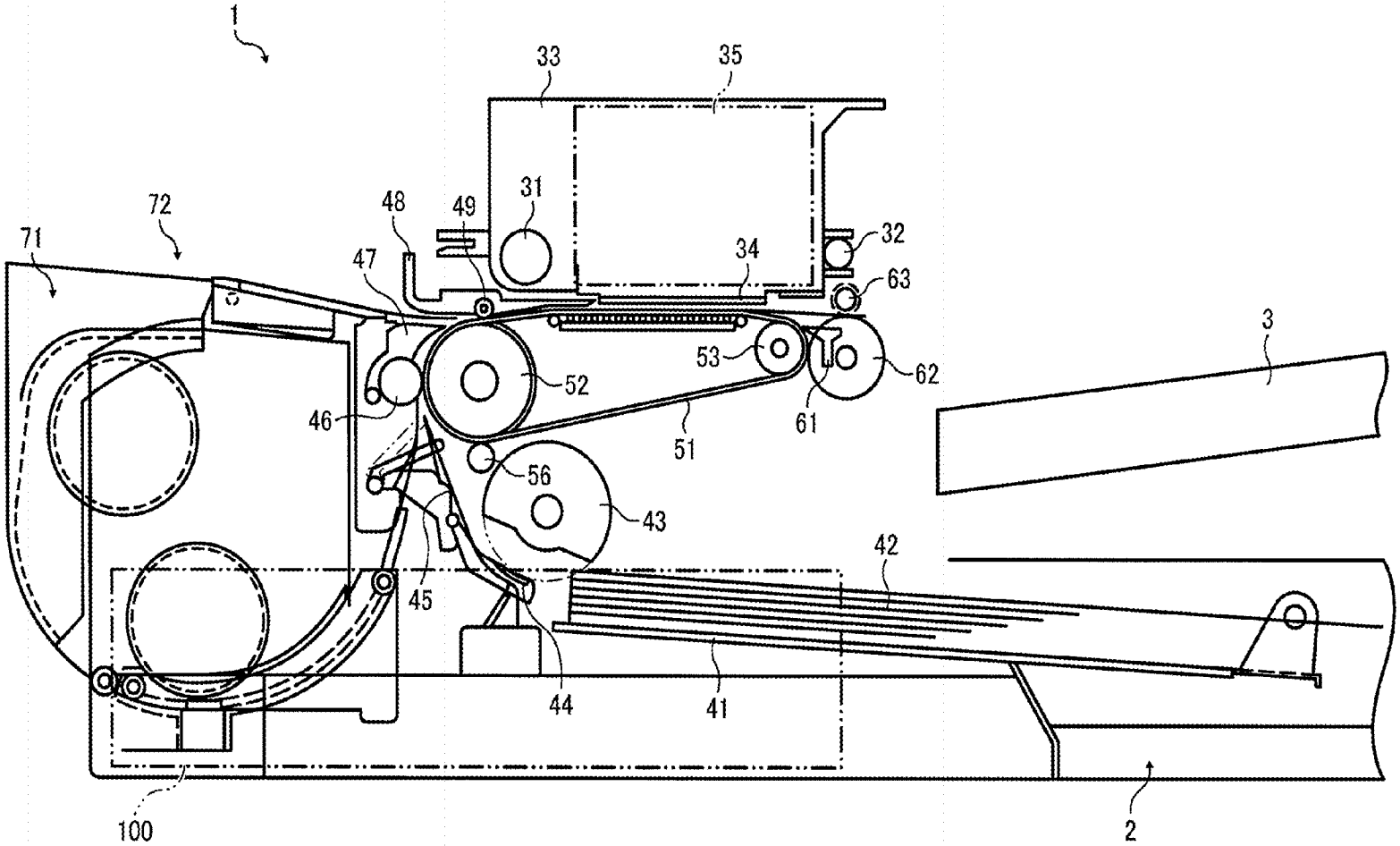
FIG. 13 is a side view illustrating the entire configuration of an example of the inkjet recording device according to an embodiment of the present invention.
Figure 14:
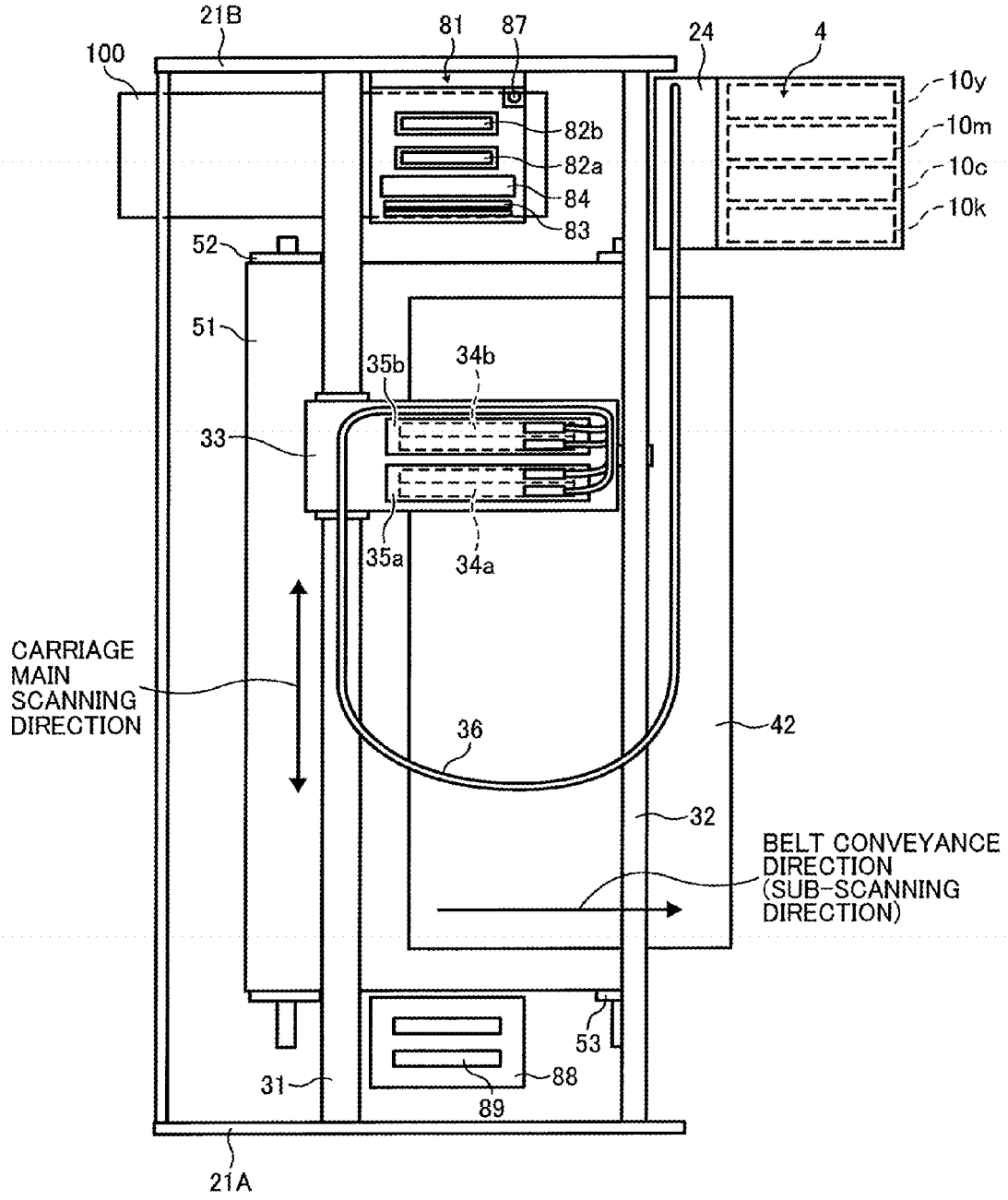
FIG. 14 is a plane view illustrating the entire configuration of an example of the inkjet recording device according to an embodiment of the present invention.

An embodiment of the inkjet recording device of the present disclosure is described with reference to FIGS. 13 and 14. FIG. 13 is a side view of an inkjet recording device illustrating the entire configuration thereof and FIG. 14 is a planar view thereof.

This inkjet recording device is a serial type inkjet recording device. In the device, a carriage 33 is slidably supported in the main scanning direction by main and sub guide rods 31 and 32 serving as a guide member laterally bridged between left and right side plates 21A and 21B. The inkjet recording device moves and scans in the direction indicated by the arrow illustrated in FIG. 14 by a main scanning motor via a timing belt.

The carriage 33 carries a recording head 34*a* and 34*b* (recording head 34 if not necessary to be distinguished from each other) including liquid discharging heads to discharge ink droplets of each color of yellow (Y), cyan (C), magenta (M), and black (Bk). In addition, nozzle lines of multiple nozzles therein are arranged in the sub-scanning direction crossing vertically with the main scanning direction with the ink droplet discharging direction downward.

The recording heads 34 each include two nozzle lines. One of the nozzle lines of the recording head 34*a* discharges droplets of black (K) and the other discharges droplets of cyan (C). One of the nozzle lines of the recording head 34*b* discharges droplets of magenta (M) and the other discharges droplets of yellow (Y). It is also possible to use a recording head including nozzle lines of each color having multiple nozzles on the surface of a single nozzle plate as the recording head 34.

The carriage 33 carries sub-tanks 35*a* and 35*b* (sub-tank 35 if not distinguished) serving as a second ink supplying unit to supply each color ink corresponding to the nozzle line of the recording head 34. The recording liquid of each color is replenished with and supplied to this sub-tank 35 from ink containers (main tank) 10*y*, 10*m*, 10*c*, and 10*k* detachably attached to an ink container installation unit 4 by a supply pump unit 24 via a supply tube 36 for each color.

A sheet feeding unit to feed a sheet 42 loaded on a sheet loader (pressure plate) 41 of a sheet feeder tray 2 includes a half-moon shape roller (sheet feeding roller) 43 to separate and feed the sheet 42 one piece by one piece from the sheet loader 41 and a separation pad 44 made of a material having a large friction index and arranged facing the sheet feeding roller 43 while being biased towards the sheet feeding roller 43.

To feed the sheet 42 fed from the sheet feeding unit below the recording head 34, there are provided a guide member 45 to guide the sheet 42, a counter roller 46, a transfer guide member 47, a pressing member 48 including a front end pressing roller 49, and a conveyor belt 51 serving as a conveying device to electrostatically adsorb the sheet 42 and transfer the sheet 42 at a position facing the recording head 34.

The conveyor belt 51 is an endless form belt, stretched between a conveying roller 52 and a tension roller 53 and configured rotatable in the belt conveying direction (sub-scanning direction). In addition, a charging roller 56 serving as a charger is disposed to charge the surface of the conveyor belt 51. This charging roller 56 is disposed to be in contact with the surface layer of the conveyor belt 51 in order to be rotationarily driven to the rotation of the conveyor belt 51. The conveyor belt 51 circularly moves in the belt conveying direction illustrated in FIG. 14 by the conveying roller 52 rotationarily driven by a sub-scanning motor.

Furthermore, as the sheet ejection unit to eject the sheet 42 having an image recorded thereon by the recording head 34, there are provided a separation claw 61 to separate the sheet 42 from the conveyor belt 51, an ejection roller 62, and an ejection roller 63. A sheet ejection tray 3 is disposed below the ejection roller 62.

A double-face print unit 71 is installed onto the rear side of an inkjet recording device 1 in a detachable manner. The double-face print unit 71 takes in and reverses the sheet 42 returned by the reverse rotation of the conveyor belt 51 and feeds it again between the counter roller 46 and the conveyor belt 51. In addition, the upper surface of the double-face unit 71 serves as a bypass tray 72.

Furthermore, a maintenance and recovery mechanism 81 is disposed in the non-image forming area on one side of the carriage 33 in the scanning direction thereof and maintains and recovers the state of the nozzle of the recording head 34. The maintenance and recovery mechanism 81 includes each capping member (hereinafter referred to as cap), i.e., 82*a* and 82*b* (simply 82 when not necessary to be distinguished from each other), a wiping member (wiper blade) 83 to wipe off the surface of the nozzle plate, a dummy discharging receiver 84 to receive droplets discharged not for recording but for dummy discharging to discharge thickened recording liquid, and a carriage lock 87 to lock the carriage 33. In addition, below the maintenance and recovery mechanism 81, a waste liquid tank 100 is attached to the inkjet recording device 1 in an exchangeable manner to accommodate waste liquid collected during the maintenance and recovery operation.

In addition, in the non-image forming areas on the other side of the carriage 33 in the scanning direction, a dummy discharging receiver 88 is disposed to receive droplets discharged not for recording but for dummy discharging to remove the recording liquid thickened during recording, etc. The dummy discharging receiver 88 includes slits 89 along the direction of the nozzle line of the recording head 34.

In the inkjet recording device configured in the manner described above, the sheet 42 is separated and fed from the sheet feeder tray 2 one piece by one piece substantially vertically upward, guided by the guide member 45, and transferred while being pinched between the conveyor belt 51 and the counter roller 46. Moreover, the front of the sheet 42 is guided by the conveying guide 47 and pressed to the conveying belt 51 by the front end pressing roller 49 to change the transfer direction substantially 90 degrees C.

During this operation, positive and negative voltages are alternately applied to the charging roller 56 to charge the conveyor belt 51 in an alternate charging voltage pattern. When the sheet 42 is fed onto the conveyor belt 51 charged with this alternate pattern, the sheet 42 is adsorbed to the conveyor belt 51 and conveyed thereon in the sub-scanning direction by the circulation movement of the conveyor belt 51.

By driving the recording head 34 in response to image signals while moving the carriage 33, ink droplets are discharged to the sheet 42 standing still to record an image thereon for an amount corresponding to one line and thereafter the sheet 42 is conveyed in a predetermined amount for recording in the next line. On receiving a signal indicating that the recording is finished or the rear end of the sheet 42 has reached the image recording area, the recording operation stops and the sheet 42 is ejected to the ejection tray 3.

When maintaining and recovering the nozzle of the recording head 34, the carriage 33 is moved to the position (home position) facing the maintenance and recovery mechanism 81, the maintenance and recovery operation is conducted by capping by the capping member 82 for nozzle suction and dummy discharging to discharge liquid droplets not contributing to image forming. For this reason, liquid droplets are stably discharged to form images.

Figure 15:
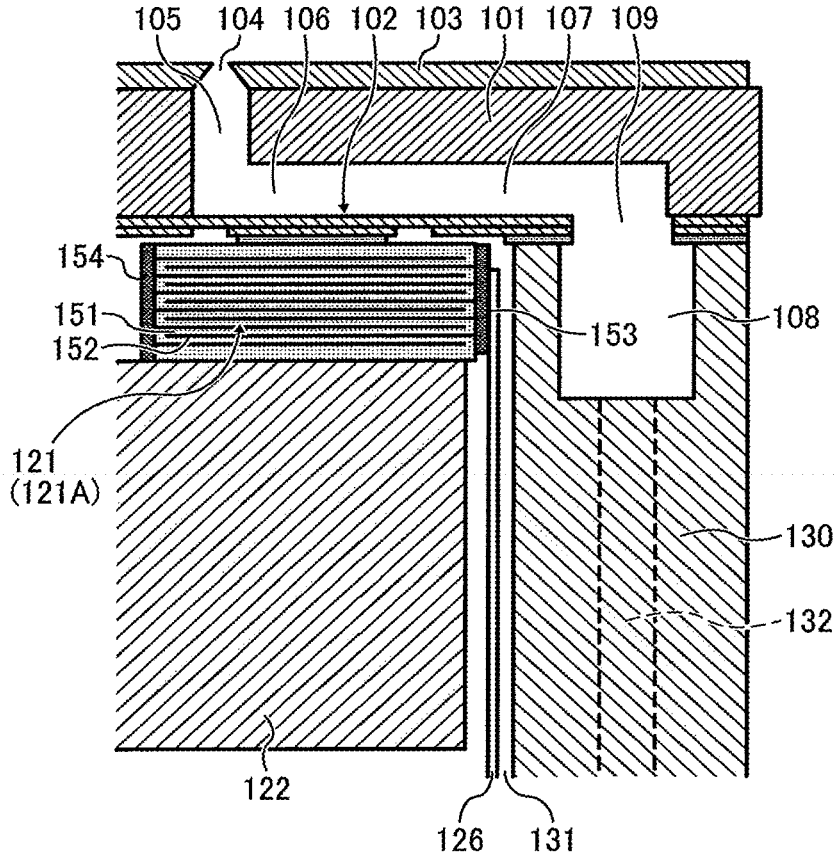
FIG. 15 is a diagram illustrating a cross section of an example of the liquid discharging head constituting the recording head of the inkjet recording device in the longitudinal direction of the liquid chamber according to an embodiment of the present disclosure.
Figure 16:
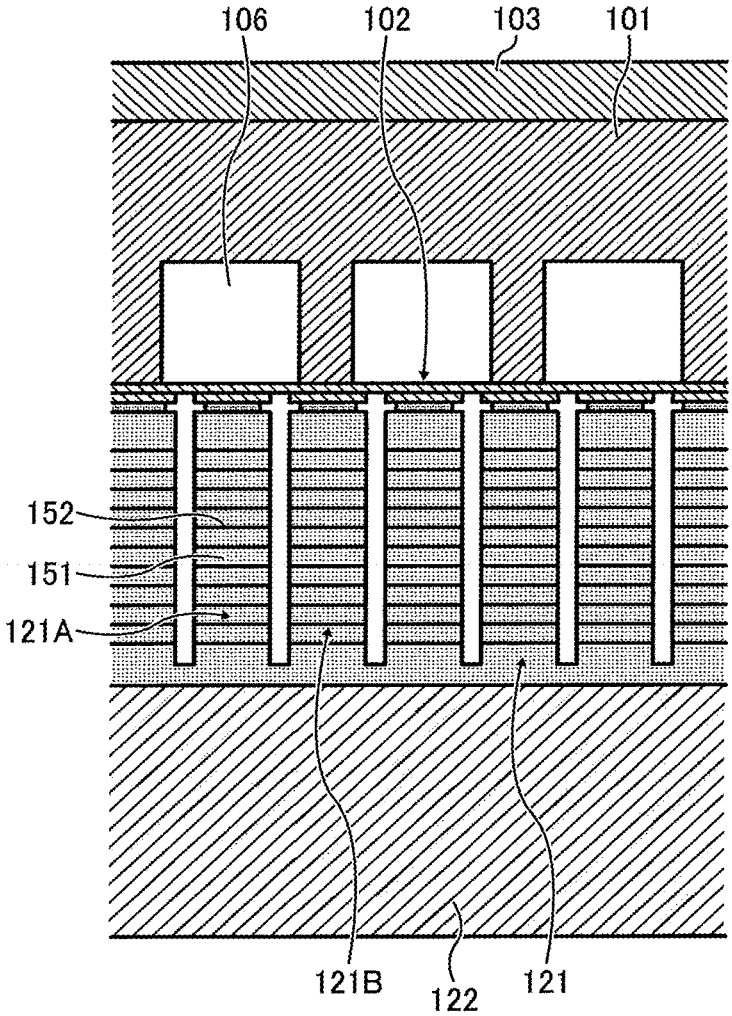
FIG. 16 is a diagram illustrating a cross section of an example of the liquid discharging head constituting the recording head of the inkjet recording device in the traverse direction of the liquid chamber according to an embodiment of the present disclosure.

Next, an embodiment of the liquid discharging head constituting the recording head 34 is described with reference to FIGS. 15 and 16. FIG. 15 is a cross section along the longitudinal direction of the liquid chamber of the recording head 34 and FIG. 16 is a cross section along the traverse direction (direction of nozzle alignment) of the liquid chamber of the recording head 34.

In this liquid discharging head, a vibration plate 102 is attached to the bottom surface of a flow path plate 101 and a nozzle plate 103 is attached to the top surface of the flow path plate 101. These form a nozzle communicating path 105 serving as a flow path communicating with a nozzle 104 to discharge liquid droplets (ink droplets), a liquid chamber 106 serving as a pressure generating chamber, and an ink supplying hole 109 communicating with a common liquid chamber 108 to supply ink to the liquid chamber 106 through a fluid resistance portion (supply path) 107.

In addition, the liquid discharging head includes two laminating type piezoelectric members (electromechanical transduction element) 121 serving as a pressure generating device (actuator) transforming the vibration plate 102 to apply a pressure to ink in the liquid chamber 106 and a base substrate 122 where the piezoelectric member 121 is attached and fixed. FIG. 15 illustrates only one line of the piezoelectric members 121. This piezoelectric member 121 includes multiple piezoelectric element pillars 121A and 121B by forming grooves by non-separating slit processing. In this embodiment, the piezoelectric element pillar 121A is a drive piezoelectric element pillar to apply a drive waveform and the piezoelectric element pillar 121B is a non-drive piezoelectric element pillar, which does not apply a drive waveform. In addition, an FPC cable 126 including a drive circuit (drive IC) is connected to the drive piezoelectric element pillar 121A of the piezoelectric member 121.

The peripheral site of the vibration plate 102 is attached to a frame member 130. A piecing unit 131 accommodating an actuator unit configured by the piezoelectric member 121, the base substrate 122, etc, a concave portion forming the common liquid chamber 108, and an ink supply orifice 132 serving as a liquid supply hole to supply ink to the common liquid chamber 108 from outside are formed in the frame member 130.

On the flow path plate 101, for example, the concave portion and hole portion are formed as the nozzle communicating path 105 and the liquid chamber 106 by anisotropic etching a single crystal silicon substrate having crystal plane orientation (110) using alkali etching liquid such as potassium hydroxide (KOH) aqueous liquid. However, the flow path plate 101 is not limited to the single crystal silicon substrate but other stainless substrates and photoconductive resins can be used.

The vibration plate 102 is formed out of nickel metal plate and manufactured by, for example, an electroforming method. Also, metal plates and joint members of metal and resin plates may be used. The piezoelectric element pillars 121A and 121B of the piezoelectric member 121 are glued to the vibration plate 102 and the frame member 130 is glued thereto.

On the nozzle plate 103, the nozzle 104 having a diameter of from 10 to 30 μm is formed corresponding to each liquid chamber 106. The nozzle plate 103 is glued to the flow path plate 101 with an adhesive. It is preferable that a repellent film be formed on the uppermost surface of the nozzle forming member made of a metal member on the ink discharging side of the surface via a predetermined layer.

The piezoelectric member 121 is a lamination type piezoelectric element (PZT in this case) in which a piezoelectric material 151 and an inside electrodes 152 are alternately laminated. Each inside electrode 152 alternately pulled out to different end surfaces of the piezoelectric member 121 is connected to an individual electrode 153 and a common electrode 154. In this embodiment, it is possible to have a configuration in which the ink in the liquid chamber 106 is pressurized using the displacement along a d33 direction as the piezoelectric direction of the piezoelectric member 121 or another configuration in which the ink in the liquid chamber 106 can be pressurized using the displacement along a d31 direction as the piezoelectric direction of the piezoelectric member 121.

In the liquid discharging head configured as described above, for example, when the voltage applied to the piezoelectric member 121 is lowered from a reference voltage Ve, the drive piezoelectric element pillar 121A is contracted and the vibration plate 102 is lowered, thereby inflating the volume of the liquid chamber 106. As a result, the ink flows into the liquid chamber 106 and thereafter the voltage applied to the piezoelectric element pillar 121A is increased to elongate the piezoelectric element pillar 121A in the lamination direction. Accordingly, the vibration plate 102 is transformed along the direction of the nozzle 104 to contract the volume of the liquid chamber 106. As a result, the ink in the liquid chamber 106 is pressurized so that ink droplets are discharged (jetted) from the nozzle 104.

Thereafter, the voltage applied to the piezoelectric member 121A is returned to the reference voltage Ve. Accordingly, the vibration plate 102 is back to the initial position so that the liquid chamber 106 inflates, which generates a negative pressure. At this point in time, the ink is supplied from the common liquid chamber 108 to the liquid chamber 106. After the vibration of the meniscus surface of the nozzle 104 decays and is stabilized, the system starts behaviors to discharge next droplets.

The drive method of the head is not limited to the above-mentioned (pull-push discharging). The way of discharging changes depending on how a drive waveform is provided (for example, pull discharging or push discharging).

In inkjet recording, the form and manufacturing accuracy of a nozzle and the surface property of a nozzle plate are known to have a large impact on the discharging property of ink droplets. If ink is attached around a nozzle on the surface of a nozzle plate, the discharging direction of ink droplets is deviated or jetting speed may be unstable. To prevent such problems stemming from ink attachment, a repellent film is formed on the surface of the nozzle plate to impart repellency to stabilize discharging of ink droplets.

However, when removing ink attached to the repellent film during maintenance such as suction, the repellent film is gradually peeled off, which degrades repellency of the nozzle plate. In an attempt to solve this problem, attachability between the repellent film and the nozzle plate is improved. However, it is not easy to prevent the degradation of the repellent film.

The recording head for use in the present disclosure has a nozzle plate having nozzles and the nozzle plate preferably includes a repellent film disposed on the surface thereof on the ink discharging side. It is suitable to provide an under layer of an inorganic oxide as an under layer of the repellent film before forming the repellent film on the surface of the nozzle plate.

The repellent film can be any known repellent film and preferably contains a polymer having a perfluoroalkyl chain. Preferably, the repellent film is formed in the following manner.

(1) Solgel method: A repellency treatment agent solution prepared by dissolving in a solvent either or both of a polymer and an oligomer including at least one perfluoroalkyl group and at least one alkoxysilyl group and a silane compound represented by the following chemical formula II is applied to the surface of the nozzle plate mentioned above on the ink discharging side and thereafter reaction is conducted to form a repellent film, which is thereafter fixated.

$Si(Y)(OR)_3$ Chemical formula II

In the chemical formula II, R represents a hydrogen atom or an alkyl group, Y represents an alkyl group that may have a substitution group, an aryl group that may have a substitution group, or an OR group in the chemical formula II. Individual Rs each, can independently be the same or different.

(2) Vapor deposition method: a SiO2 film is formed on the surface on the ink droplet discharging side and at least either or both (A) of a polymer or an oligomer including at least one perfluoroalkyl group and at least one alkoxysilyl group and a silane compound (B) represented by the following chemical formula II are repeatedly vapor deposited on the SiO2 film as the vapor deposition sources in different zones in a vacuum tank to react the vapor-deposited (A) and the (B) to form a repellent film, which is thereafter fixated.

Figure 17:
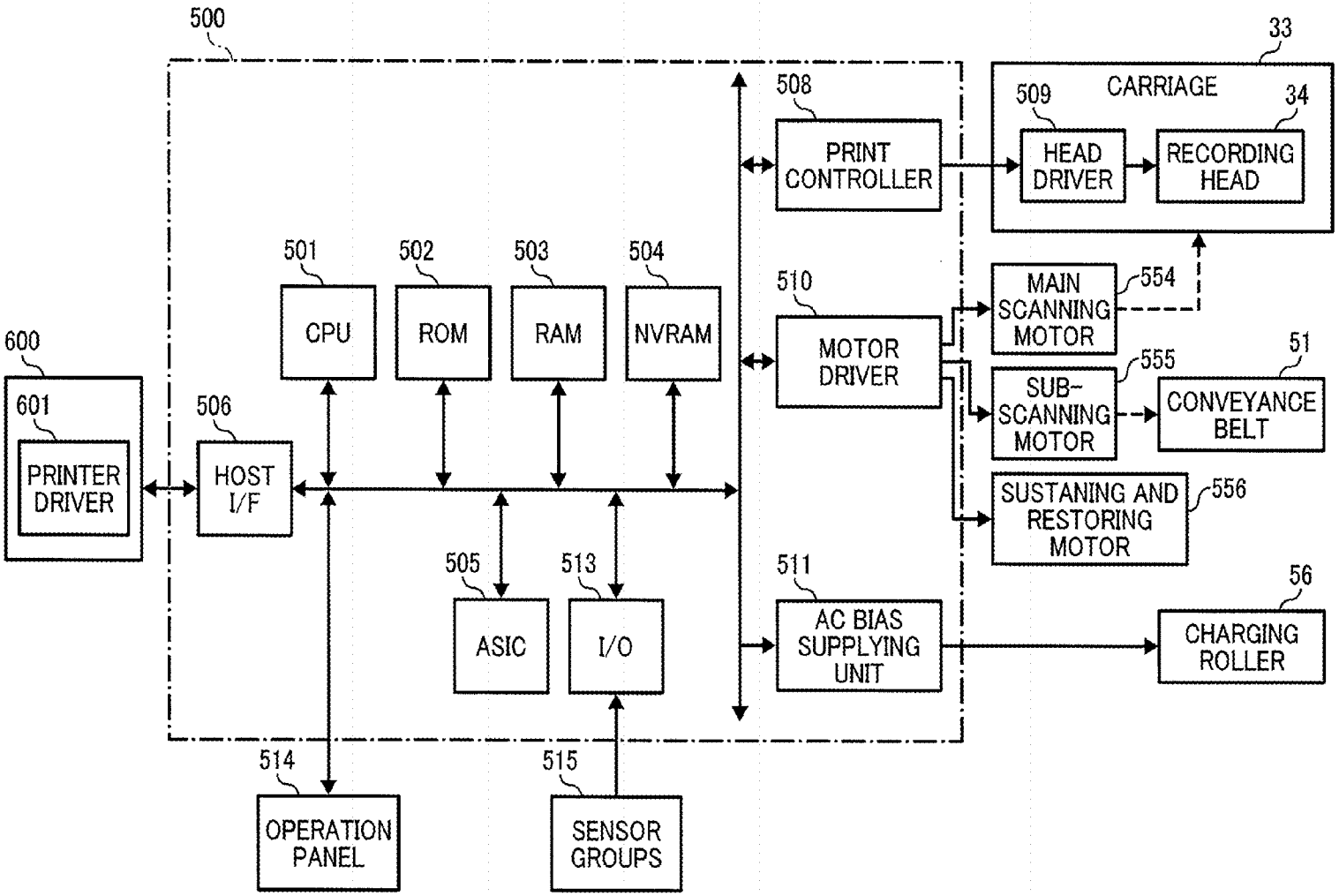
FIG. 17 is a block diagram illustrating an example of the control unit of the inkjet recording device according to an embodiment of the present disclosure.

Next, the control unit of the inkjet recording device is described with reference to FIG. 17. FIG. 17 is a block diagram illustrating the control unit.

This control unit 500 includes a central processing unit (CPU) 501 to control the entire device including the dummy discharging operation, programs executed by the CPU 501, a read-only memory (ROM) 502 to store other fixed data, a random access memory (RAM) 503 to temporarily store image data, etc., a non-volatile random access memory (NVRAM) 504 on which data are rewritable to hold data even while the power supply is cut, and an application specific integrated circuit (ASIC) 505 to conduct various signal processing for image data, image processing for sorting, etc., and input and output signals to control the entire apparatus.

In addition, the control unit 500 also includes a data transfer device to drive and control the recording head 34, a print control unit 508 including a signal generating device, a head driver (driver IC) 509 to drive the recording head 34 disposed on the side of the carriage 33, a main scanning motor 554 to move and scan the carriage 33, a sub-scanning motor 555 to circularly move the conveyor belt 51, a motor control unit 510 to drive a maintenance and recovery motor 556 for moving the cap 82 and the wiping member 83 of the maintenance and recovery mechanism 81, and an AC bias supplying unit 511 to supply an AC bias to the charging roller 56.

In addition, this control unit 500 is connected to an operation panel 514 to input and display information for the device.

The control unit 500 includes an I/F 506 to send and receive data and signals with a host computer so that it can receive such data from a host 600 such as an image processing device such as a home computer, an image reader such as an image scanner, and an imaging device such as a digital camera at the I/F 506 via a cable or a network.

The CPU 501 of the control unit 500 reads and analyzes print data in the reception buffer included in the I/F 506, conducts image processing and data sorting processing at an ASIC 505, and transfers the image data from the print control unit 508 to the head driver 509.

The dot pattern data to output images are created at a printer driver 601 on the host 600

In addition to transferring serial data of the image data mentioned above, the print control unit 508 outputs transfer clocks, latch signals, control signals, etc. required to transfer the image data and determine the transfer. Moreover, the print control unit 508 includes a drive signal generating unit configured by a D/A converter to digital-analogue convert the pattern data of a drive pulse stored in the ROM, a voltage amplifier, a current amplifier, etc. and outputs a particular signal for use in the present disclosure to the head driver 509.

The head driver 509 selects a drive pulse constituting a drive waveform provided from the print control unit 508 based on the serially input image data corresponding to an amount of a single line of the recording head 34 to generate a draw-in pulse and a discharging pulse and applies the pulses to a piezoelectric element serving as a pressure generating device generating an energy to discharge droplets of the recording head 34, thereby driving the recording head 34. At this point, part or the entire of the drive pulse constituting the drive waveform and part or the entire of the element for waveform forming the drive pulse are selected to discharge droplets having different sizes, for example, large droplets, middle-sized droplets, small droplets so that dots having different sizes can be formed.

An I/O unit 513 acquires information from various sensors 515 installed onto the device, extracts the information to control a printer, and use it to control the print control unit 508, the motor control unit 510, and the AC bias supplying unit 511. The sensors 515 includes an optical sensor to detect the position of a sheet, a thermistor to monitor the temperature in the device, a sensor to monitor the voltage of the charging belt, and an interlock switch to detect open and close of a cover. The I/O unit 513 is capable of processing various kinds of sensor information.

Figure 18:
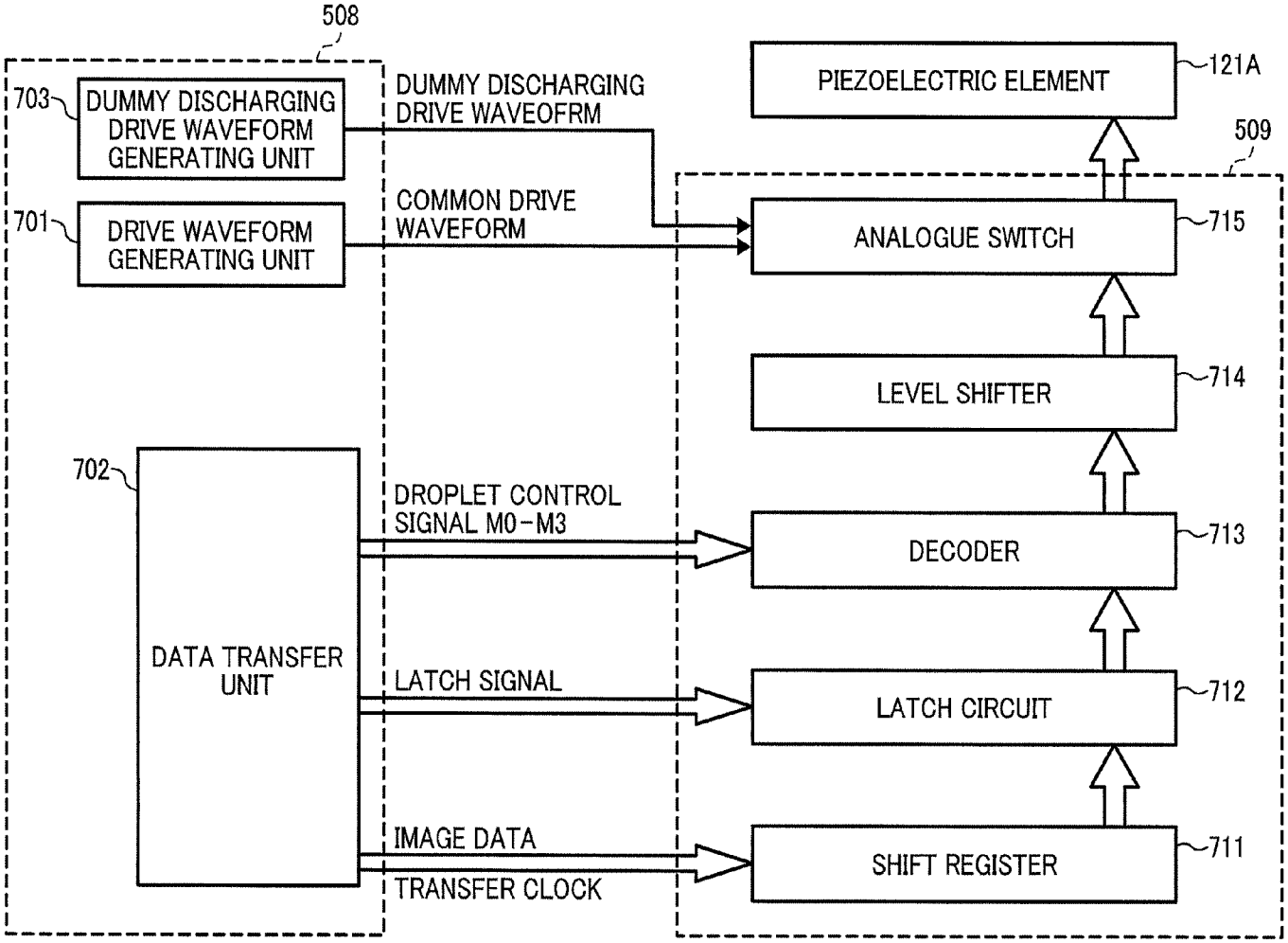
FIG. 18 is a diagram illustrating an example of the print control unit and the head driver of the inkjet recording device according to an embodiment of the present disclosure.

Next, an embodiment of the print control unit 508 and the head driver 509 are described with reference to FIG. 18.

The print control unit 508 includes a drive waveform generating unit 701 to generate and output a drive waveform having a drive pulse having a voltage changing time of the inflating waveform element (voltage changing part to draw in ink in a nozzle) of ⅓ or more of the resonance period of the liquid chamber in a single print cycle during image forming, a data transfer unit 702 to output 2-bit image data (gradation signals 0 and 1) corresponding to print image, clock signals, latch signals (LAT), and droplet control signals M0 to M3, and a dummy discharging drive waveform generating unit 703 to generate and output a drive waveform for dummy discharging.

The droplet control signal is a 2-bit signal to provide an instruction for every droplet on open and close of an analogue switch 715 serving as a switching device of the head driver 509 and transitions to H level (ON) by a drive pulse or a drive waveform selected to the print cycle of the common drive waveform and to L level (OFF) when not selected.

The head driver 509 includes a shift resistor 711 to input a transfer clock (shift clock) from the data transfer unit 702 and a serial image data (gradation data: 2 bit/1 channel, per nozzle), a latch circuit 712 to latch each resist value of the shift resistor 711 by a latch signal, a decoder 713 to decode the gradation data and the control signals M0 to M3 to output the result, a level shifter 714 to change a logic level voltage signal of the decoder 713 to a level where the analogue switch 715 is operable, and the analogue switch 715 made open and close by the output of the decoder 713 provided via the level shifter 714.

Recording Medium

The recording medium for use in recording is not particularly limited. Specific examples thereof include, but are not limited to, plain paper, gloss paper, special paper, cloth, film, transparent sheets, printing paper for general purpose.

Recorded Matter

The recorded matter of the present disclosure includes a recording medium and an image formed on the recording medium with the ink of the present disclosure.

An inkjet recording device and an inkjet recording method are used to record the image on the recording medium to obtain the recorded matter.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Next, the present disclosure is described in detail with reference to Examples but is not limited thereto. "Part" represents parts by mass unless otherwise specified. "Percent" represents percent by mass unless otherwise specified.

Manufacturing Example 1 of Pigment Dispersion

Manufacturing of Cyan Dispersion

After sufficient replacement with nitrogen gas in a flask equipped with a mechanical stirrer, a thermometer, a nitrogen gas introducing tube, a reflux tube, and a dripping funnel, 11.2 g of styrene, 2.8 g of acrylic acid, 12.0 g of lauryl methacrylate, 4.0 g of polyethlene glycol methacrylate, 4.0 g of styrene macromer (AS-6, manufactured by TOA GOSEI CO., LTD.), and 0.4 g of mercapto ethanol were charged in the flask and the system was heated to 65 degrees C. Next, a liquid mixture of 100.8 g of styrene, 25.2 g of acrylic acid, 108.0 g of lauryl methacrylate, 36.0 g of polyethylene glycol methacrylate, 60.0 g of hydroxyethyl methacrylate, 36.0 g of styrene macromer (AS-6, manufactured by TOA GOSEI CO., LTD.), 3.6 g of mercapto ethanol, 2.4 g of azobisdimethyl valeronitrile, and 18 g of methylethyl ketone was dripped into the flask in two and a half hours.

Subsequently, a liquid mixture of 0.8 g of azobisdimethyl valeronitrile and 18 g of methylethyl ketone was dripped into the flask in half an hour.

Subsequent to one-hour aging at 65 degrees C., 0.8 parts of azobisdimethyl valeronitrile was added followed by furthermore one-hour aging.

After completion of the reaction, 364 g of methylethyl ketone was added to the flask to obtain 800 g of polymer solution having a concentration of 50 percent by mass.

Next, part of the polymer solution was dried. The weight average molecular weight was 15,000 as measured by gel permeation chromatography (standard: polystyrene, solvent: tetrahydrofuran).

28 g of the polymer solution, 26 g of pigment blue 15:3 (CHROMOFINE BLUE A-220JC, manufactured by Dainichiseika Color & Chemicals Mfg. Co., Ltd.), 13.6 g of 1 mol/l potassium hydroxide solution, 20 g of methylethyl ketone, and 30 g of deionized water were sufficiently stirred.

Thereafter, the resultant was mixed and kneaded 20 times by a three-roll mill (Product name: NR-84A, manufactured by NORITAKE CO., LIMITED). The thus-obtained paste was charged in 200 g of deionized water. Subsequent to sufficient stirring, methylethyl ketone and water were distilled away using an evaporator to obtain 160 g of a blue polymer particulate dispersion having a solid portion of 20.0 percent by mass.

The average particle diameter (D50) of the thus-obtained polymer particulate was 98 nm as measured by MICROTRAC UPA (manufactured by NIKKISO CO., LTD.).

Manufacturing Example 2 of Pigment Dispersion

Manufacturing of Magenta Dispersion

A red violet polymer particulate dispersion was obtained in the same manner as in the Manufacturing Example 1 of the pigment dispersion except that pigment blue 15:3 (copper phthalocyanine pigment) was changed to pigment red 122 (CHROMOFINE MAGENTA 6886, manufactured by Dainichiseika Color & Chemicals Mfg. Co., Ltd.).

The average particle diameter (D50) of the thus-obtained polymer particulate was 124 nm as measured by MICROTRAC UPA (manufactured by NIKKISO CO., LTD.).

Manufacturing Example 3 of Pigment Dispersion

Manufacturing of Yellow Dispersion

A yellow polymer particulate dispersion was obtained in the same manner as in the Manufacturing Example 1 of the pigment dispersion except that pigment blue 15:3 (copper phthalocyanine pigment) was changed to pigment yellow 74 (FAST YELLOW 531, manufactured by Dainichiseika Color & Chemicals Mfg. Co., Ltd.).

The average particle diameter (D50) of the thus-obtained polymer particulate was 78 nm as measured by MICROTRAC UPA (manufactured by NIKKISO CO., LTD.).

Manufacturing Example 4 of Pigment Dispersion

Manufacturing of Black Dispersion

A black polymer particulate dispersion was obtained in the same manner as in the Manufacturing Example 1 of the dispersion except that pigment blue 15:3 (copper phthalocyanine pigment) was changed to carbon black (FW100, manufactured by Degussa AG).

The average particle diameter (D50) of the thus-obtained polymer particulate was 110 nm as measured by MICROTRAC UPA (manufactured by NIKKISO CO., LTD.).

Ink Preparation Examples 1 to 12

Each ink of Ink Preparation Examples 1 to 12 was manufactured by an ordinary method following the prescription shown in Tables 1 to 2 using each pigment dispersion manufactured in the Manufacturing Examples 1 to 4 of the pigment dispersion and adjusted to be pH 9 by 10 percent aqueous solution of sodium hydroxide.

Specifically, a water-soluble organic solvent, a surfactant, a fungicide, a foam inhibitor, a defoaming agent, a permeating agent, and deionized water were prescribed in this sequence and stirred for 30 minutes. Thereafter, the pigment dispersions obtained in the Manufacturing Examples 1 to 4 of the pigment dispersion were added. Subsequent to stirring for 30 minutes, the resultant was filtrated by a membrane filter having a hole diameter of 0.8 μm to obtain each ink of Ink Preparation Examples 1 to 12. The values in Tables 1 to 2 is represented in percent by mass.

TABLE 1

| | | Preparation examples of ink | | | | | |
|---|---|---|---|---|---|---|---|
| | | 1 | 2 | 3 | 4 | 5 | 6 |
| Manufacturing Example 1 of dispersion | C | 40.0 | | | | 25.0 | |
| Manufacturing Example 2 of dispersion | M | | 50.0 | | | | 35.0 |
| Manufacturing Example 3 of dispersion | Y | | | 40.0 | | | |
| Manufacturing Example 4 of dispersion | K | | | | 50.0 | | |
| Surfactant | Surfactant A | 0.05 | 0.05 | 0.05 | 0.03 | 0.03 | 0.03 |
| | Surfactant B | | | | | | |
| | Surfactant C | | | | | | |
| | Surfactant D | | | | | | |
| Organic solvent | Glycerin | | | | | 10.0 | 10.0 |
| | 3-methyl-1,3-butane diol | | | 7.0 | | | |
| | 1,3-butane diol | | | | | 25.0 | |
| | 1,2-butane diol | | | | 13.0 | | |
| | 1,2-propanediol | 27.0 | 40.0 | 35.0 | 26.0 | | |
| | 1,6-hexane diol | 5.0 | | | | | |
| | 1,5-pentane diol | | | | | | 25.0 |
| | 2-pyrroridone | | | | | | |
| | 2-ethyl-1,3-hexanediol | 3.0 | 3.0 | 3.0 | 3.0 | 3.0 | 3.0 |
| Foam inhibitor | 2,4,7,9-tetramethyldecane-4,7-diol | 0.30 | 0.30 | 0.30 | 0.30 | 0.30 | 0.30 |
| Defoaming agent | KM-72F | | | | | | |
| Fungicides | PROXEL LV | 0.20 | 0.20 | 0.20 | 0.20 | 0.20 | 0.20 |
| pH regulator | 10 percent aqueous solution of sodium hydroxide | Proper quantity | Proper quantity | Proper quantity | Proper quantity | Proper quantity | Proper quantity |
| Deionized water | | Rest | Rest | Rest | Rest | Rest | Rest |
| Total | | 100.0 | 100.0 | 100.0 | 100.0 | 100.0 | 100.0 |

TABLE 2

| | | Preparation examples of ink | | | | | |
|---|---|---|---|---|---|---|---|
| | | 7 | 8 | 9 | 10 | 11 | 12 |
| Manufacturing Example 1 of dispersion | C | | | 15.0 | | | |
| Manufacturing Example 2 of dispersion | M | | | | 20.0 | | |
| Manufacturing Example 3 of dispersion | Y | 20.0 | | | | 20.0 | |

TABLE 2-continued

| | | Preparation examples of ink | | | | | |
|---|---|---|---|---|---|---|---|
| | | 7 | 8 | 9 | 10 | 11 | 12 |
| Manufacturing Example 4 of dispersion | K | | 25.0 | | | | 18.0 |
| Surfactant | Surfactant A | | | | | | |
| | Surfactant B | | | 2.5 | 2.5 | | |
| | Surfactant C | 0.50 | 0.50 | | | | |
| | Surfactant D | | | | | 2.0 | 2.0 |
| Organic solvent | Glycerin | 10.0 | 10.0 | 25.0 | 25.0 | 7.0 | 7.0 |
| | 3-methyl-1,3-butane diol | | | | | 30.0 | |
| | 1,3-butane diol | 30.0 | | | | | 35.0 |
| | 1,2-butane diol | | 30.0 | | | | |
| | 1,2-propanediol | | | 10.0 | | | |
| | 1,6-hexane diol | | | | | | |
| | 1,5-pentane diol | | | | 15.0 | | |
| | 2-pyrroridone | | | 1.0 | 1.0 | | |
| | 2-ethyl-1,3-hexanediol | 3.0 | 3.0 | 3.0 | 3.0 | 3.0 | 3.0 |
| Foam inhibitor | 2,4,7,9-tetramethyldecane-4,7-diol | 0.30 | 0.30 | | | 0.30 | 0.30 |
| Defoaming agent | KM-72F | | | 3.0 | 3.0 | | |
| Fungicides | PROXEL LV | 0.20 | 0.20 | 0.20 | 0.20 | 0.20 | 0.20 |
| pH regulator | 10 percent aqueous solution of sodium hydroxide | Proper quantity | Proper quantity | Proper quantity | Proper quantity | Proper quantity | Proper quantity |
| Deionized water | | Rest | Rest | Rest | Rest | Rest | Rest |
| Total | | 100.0 | 100.0 | 100.0 | 100.0 | 100.0 | 100.0 |

Abbreviated symbols in Tables 1 to 2 are as follows.

Surfactant A: Fluorochemical surfactant (UNIDYNE DSN-403N, mixture of addition reaction product of perfluoroalkyl polyethylene oxide and polyethylene glycol, manufactured by DAIKIN INDUSTRIES, ltd.)

Surfactant B: Fluorochemical surfactant (FS-300, manufactured by E. I. du Pont de Nemours and Company)

Surfactant C: Polyether-modified silicone-based surfactant (component 100 percent by percent by weight, BYK-379, manufactured by BYK Japan KK.)

Surfactant D: Polyoxyethylene (3) tridecylether sodium acetate (ECTD-3NEX, manufactured by Nikko Chemicals Co., Ltd.)

KM-72F, self-emulsification type silicone defoaming agent (component: 100 percent by mass, manufactured by Shin-Etsu Silicone Co., Ltd.)

PROXEL LV, fungicide (manufactured by AVECIA GROUP)

Property of Ink

Viscosity, static surface tension, and dynamic surface tension were measured for each ink of the Ink Preparation Examples 1 to 12 as follows. The results are shown in Table 3.

When the difference between the static surface tension and the dynamic surface tension of each ink satisfies the following conditions 1 and 2, the evaluation is G (good). Unless both of the conditions 1 and 2 are satisfied, the evaluation is P (poor).

1. The dynamic surface tension is 10 mN/m or more greater than the static surface tension when the surface life length is 15 ms, as measured by maximum bubble pressure technique at 25 degrees C.

2. The dynamic surface tension is 3 mN/m or more greater than the static surface tension when the surface life length is 1,500 ms, as measured by maximum bubble pressure technique at 25 degrees C.

Viscosity

Viscosity (mPa·s) of each ink at 25 degrees C. was measured at appropriate rotation speed of 10-100 rpm using an R type viscometer (RC-500, manufactured by TOKI SANGYO CO., LTD.).

Static Surface Tension

Static surface tension (mN/m) of each ink at 25 degrees C. was measured by a platinum plate method using a fully-automatic surface tensiometer (CBVP-Z, manufactured by Kyowa Interface Science Co., Ltd.).

Dynamic Surface Tension

Dynamic surface tension (mN/m) of each ink at 25 degrees can be measured by, for example, a maximum bubble pressure technique using a dynamic surface tensiometer (SITA DynoTester, manufactured by SITA Messtechnik GmbH).

TABLE 3

| | Viscosity (mPa · s) | Dynamic surface tension (mN/m) 15 ms | 150 ms | 1,500 ms | Static surface tension (mN/m) | Difference between surface tensions |
|---|---|---|---|---|---|---|
| Preparation example 1 of ink | 7.78 | 37.4 | 32.5 | 30.7 | 22.0 | G |
| Preparation example 2 of ink | 8.12 | 37.7 | 32.4 | 30.2 | 21.2 | G |
| Preparation example 3 of ink | 8.23 | 38.2 | 32.5 | 30.4 | 21.7 | G |
| Preparation example 4 of ink | 8.31 | 39.7 | 34.8 | 33.5 | 25.0 | G |

TABLE 3-continued

| | Viscosity (mPa · s) | Dynamic surface tension (mN/m) 15 ms | 150 ms | 1,500 ms | Static surface tension (mN/m) | Difference between surface tensions |
|---|---|---|---|---|---|---|
| Preparation example 5 of ink | 7.78 | 39.8 | 33.9 | 31.7 | 22.8 | G |
| Preparation example 6 of ink | 7.54 | 38.8 | 33.3 | 31.3 | 22.6 | G |
| Preparation example 7 of ink | 8.24 | 37.8 | 34.0 | 31.2 | 21.4 | G |
| Preparation example 8 of ink | 8.30 | 39.8 | 36.0 | 32.4 | 22.0 | G |
| Preparation example 9 of ink | 7.25 | 37.2 | 29.8 | 27.1 | 27.2 | P |
| Preparation example 10 of ink | 8.24 | 36.9 | 29.6 | 27.1 | 27.3 | P |
| Preparation example 11 of ink | 7.59 | 36.7 | 31.5 | 27.3 | 27.1 | P |
| Preparation example 12 of ink | 7.86 | 37.0 | 31.6 | 27.6 | 27.7 | P |

Examples 1 to 10 and Comparative Examples 1 to 20

The evaluation of each ink is described next.

Preparation Prior to Printer Evaluation

In an environment of the temperature of from 24.5 to 25.5 degrees C. and 45 to 55 percent RH, the waveform at which ink was most stably discharged was selected for viscosity of each ink and used for all the print evaluation using an inkjet printer (IPSio GXe 330, manufactured by Ricoh Company Ltd.).

The inkjet printer used includes a nozzle plate having nozzles discharging ink droplets, a liquid chamber communicating with the nozzle, a recording head having a pressure generating element serving as a pressure generating device to generate a pressure in the liquid chamber, and a head driver. The head driver selects a drive pulse from the drive waveform including at least one drive pulse in a temporal sequence, generates a discharging pulse corresponding to the size of an ink droplet, applies the discharging pulse to the pressure generating element to discharge the ink droplet from the nozzle orifice and form an image on a recording medium.

The nozzle plate had a repellent film on the surface on the ink discharging side.

When discharging ink droplets from nozzle orifices to form an image on a recording medium according to the inkjet recording method of the present disclosure, the drive waveform including at least one drive pulse present in a single print cycle controls discharging at least one ink droplet from the nozzle. In general, the size of an ink droplet is controlled depending on an image to be formed. When forming a small ink droplet, one drive pulse is included. When forming a middle-sized droplet or a large droplet, multiple drive pulses are included.

Figure 19:
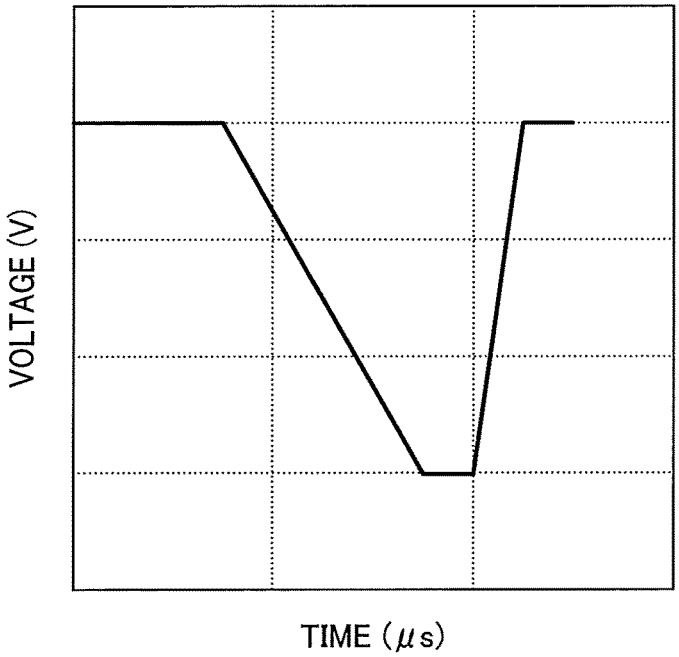
FIG. 19 is a graph illustrating a discharging waveform having a drive signal to draw in a meniscus in two steps.

At this point, in the discharging pulse (drive pulse) forming the first droplet in a single print cycle, as illustrated in FIG. 19, the discharging pulse drawing in a meniscus by the inflation waveform element (rising down voltage changing portion) having a voltage changing time of 1/1 of the resonance period of the liquid in the head is determined as "waveform 1". Similarly, the discharging pulse drawing in a meniscus by the inflation waveform element (rising down voltage changing portion having a voltage changing time of ⅓ of the resonance period of the liquid in the head is determined as "waveform 2".

Figure 20:
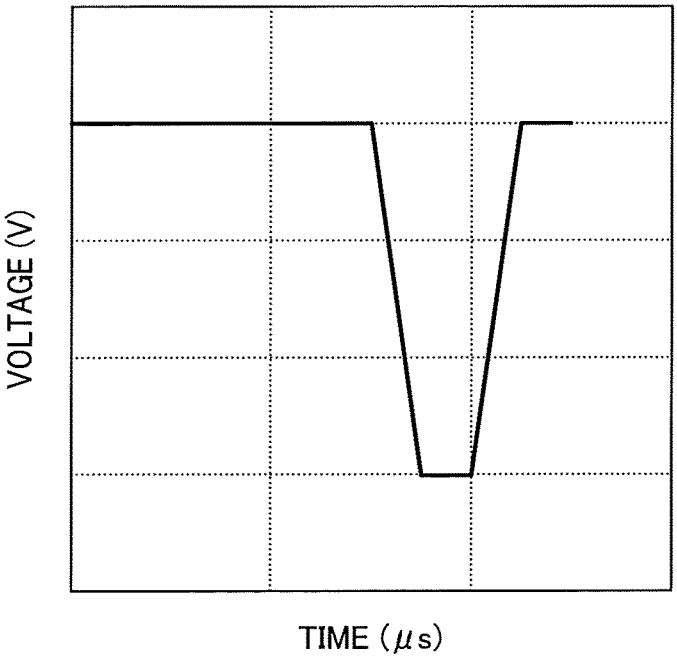
FIG. 20 is a graph illustrating a discharging waveform having a drive signal to draw in a meniscus in a single step.

As illustrated in FIG. 20, the discharging pulse drawing in a meniscus by the inflation waveform element having a short voltage changing time of ¼ of the resonance period of the liquid in the head is determined as "waveform 3".

When using the "waveform 1", the discharging results of the ink of Ink Preparation Examples 1 to 8 are Examples 1 to 8 and the discharging results of the ink of Ink Preparation Examples 9 to 12 are Comparative Examples 1 to 4.

When using the "waveform 2", the discharging results of the ink of Ink Preparation Examples 1 to 8 are Examples 9 to 16 and the discharging results of the ink of Ink Preparation Examples 9 to 12 are Comparative Examples 5 to 8.

When using the "waveform 3", the discharging results of Ink Preparation Examples 1 to 8 are Comparative Examples 9 to 16 and the discharging results of Ink Preparation Examples 9 to 12 are Comparative Examples 17 to 20.

In addition, before the evaluation, ink was attached to the surface of the nozzle plate and the surface was repeatedly wiped off by the wiper blade 4,000 times to intentionally degrade the repellent film on the surface of the nozzle plate.

Discharging Stability

Using the inkjet printer (IPSio GXe3300, manufactured by RICOH Company Ltd.), a print pattern having a print area of 5 percent for each color in the entire area of the sheet was printed on MyPaper (manufactured by NBS RICOH Company Lt.) and was printed with each ink of yellow, magenta, cyan, and black 100% duty. The print conditions were that the recording density was 600 dpi with one pass printing and a print sample of a triangle of the three waveforms of the waveform 1 to the waveform 3 was made. The sample was made by intermittent printing. That is, the print pattern was printed on 20 sheets continuously and the printing operation was halt for 20 minutes without discharging. This cycle was repeated 50 times to print the pattern on 1,000 sheets in total and thereafter the print pattern was printed on one more sheet, which was visually checked to evaluate the image with regard to streaks, dot missing, disturbance of jetting (discharging) of 5 percent chart solid portion. The evaluation criteria are as follows. "G (good)" is allowed and "M (marginal)" and "P (poor)"

Evaluation Criteria

G: No streaks, no dot missing, no jetting disturbance observed in solid portion

M: Slight streaks, dot missing, and jetting disturbance observed in one or two sites in the solid portion P: Streaks, dot missing, jetting disturbance observed all over the solid portion Uniformity of Solid Printed Portion (Uniformity of Solid Portion)

Images were formed on Ricoh Business Coat Gloss (manufactured by Ricoh Company Ltd.) by the inkjet printer (IPSio GXe3300, manufactured by Ricoh Company Ltd.). The print pattern was printed with each ink of yellow, magenta, cyan, and black 100% duty. A print sample of the three waveforms of the waveform 1 to waveform 3 was made.

Uniformity on the solid portion of the thus-obtained sample was visually checked and evaluated. The evaluation criteria are as follows. "G (good)" is allowed and "M (marginal)" and "P (poor)"

Evaluation Criteria

G: Mottle observed little on the solid portion

M: Mottle observed slightly on the solid portion

P: Mottle observed all over the solid portion

These evaluation results are shown in Tables 4 to 6. In addition, the cases in which the difference of the dynamic surface tension and the static surface tension of each ink satisfies the conditions specified above are shown in the same manner.

TABLE 4

| | | Difference between surface tensions | Wave-form | Dis-charging stability | Uniformity at solid portion |
|---|---|---|---|---|---|
| Example 1 | Preparation example 1 of ink | G | 1 | G | G |
| Example 2 | Preparation example 2 of ink | G | 1 | G | G |
| Example 3 | Preparation example 3 of ink | G | 1 | G | G |
| Example 4 | Preparation example 4 of ink | G | 1 | G | G |
| Example 5 | Preparation example 5 of ink | G | 1 | G | G |
| Example 6 | Preparation example 6 of ink | G | 1 | G | G |
| Example 7 | Preparation example 7 of ink | G | 1 | G | G |
| Example 8 | Preparation example 8 of ink | G | 1 | G | G |
| Comparative Example 1 | Preparation example 9 of ink | P | 1 | G | M |
| Comparative Example 2 | Preparation example 10 of ink | P | 1 | G | M |
| Comparative Example 3 | Preparation example 11 of ink | P | 1 | M | M |
| Comparative Example 4 | Preparation example 12 of ink | P | 1 | M | M |

TABLE 5

| | | Difference between surface tensions | Wave-form | Dis-charging stability | Uniformity at solid portion |
|---|---|---|---|---|---|
| Example 9 | Preparation example 1 of ink | G | 2 | G | G |
| Example 10 | Preparation example 2 of ink | G | 2 | G | G |
| Example 11 | Preparation example 3 of ink | G | 2 | G | G |

TABLE 5-continued

| | | Difference between surface tensions | Wave-form | Dis-charging stability | Uniformity at solid portion |
|---|---|---|---|---|---|
| Example 12 | Preparation example 4 of ink | G | 2 | G | G |
| Example 13 | Preparation example 5 of ink | G | 2 | G | G |
| Example 14 | Preparation example 6 of ink | G | 2 | G | G |
| Example 15 | Preparation example 7 of ink | G | 2 | G | G |
| Example 16 | Preparation example 8 of ink | G | 2 | G | G |
| Comparative Example 5 | Preparation example 9 of ink | D | 2 | G | M |
| Comparative Example 6 | Preparation example 10 of ink | P | 2 | G | M |
| Comparative Example 7 | Preparation example 11 of ink | P | 2 | M | M |
| Comparative Example 8 | Preparation example 12 of ink | P | 2 | M | M |

TABLE 6

| | | Difference between surface tensions | Wave-form | Dis-charging stability | Uniformity at solid portion |
|---|---|---|---|---|---|
| Comparative Example 9 | Preparation example 1 of ink | G | 3 | P | A |
| Comparative Example 10 | Preparation example 2 of ink | G | 3 | P | M |
| Comparative Example 11 | Preparation example 3 of ink | G | 3 | P | M |
| Comparative Example 12 | Preparation example 4 of ink | G | 3 | P | M |
| Comparative Example 13 | Preparation example 5 of ink | G | 3 | P | M |
| Comparative Example 14 | Preparation example 6 of ink | G | 3 | P | M |
| Comparative Example 15 | Preparation example 7 of ink | G | 3 | P | M |
| Comparative Example 16 | Preparation example 8 of ink | G | 3 | P | M |
| Comparative Example 17 | Preparation example 9 of ink | P | 3 | M | P |
| Comparative Example 18 | Preparation example 10 of ink | P | 3 | M | P |
| Comparative Example 19 | Preparation example 11 of ink | P | 3 | M | P |

TABLE 6-continued

| | | Difference between surface tensions | Waveform | Discharging stability | Uniformity at solid portion |
|---|---|---|---|---|---|
| Comparative Example 20 | Preparation example 12 of ink | P | 3 | M | P |

1. Discharging Stability Evaluation:

According to Examples 1 to 16, it is found that when a drive pulse (discharging pulse) having an inflation waveform element (rising down voltage changing portion) having a time (voltage changing time) of ⅓ or more of the resonance period of the liquid chamber is used, good discharging stability is obtained even for ink having low static surface tension.

2. Discharging Stability Evaluation:

By the comparison between Examples 1 to 16 and Comparative Examples 9 to 16, it is found that ink having a large difference between the static surface tension and the dynamic surface tension comes to have good discharging stability when a drive pulse (discharging pulse) having an inflation waveform element (rising down voltage changing portion) having a time (voltage changing time) of at least ⅓ of the resonance period of the liquid chamber is used. 3. Evaluation on Uniformity of Solid Portion:

When Examples 1-16 are compared with Comparative Examples 1, 2, 5, and 6, if the ink satisfies the condition that the dynamic surface tension is at least 10 mN/m greater than the static surface tension when the surface life length is 15 ms, as measured by maximum bubble pressure technique at 25 degrees C., but does not satisfy the condition the dynamic surface tension is at least 3 mN/m greater than the static surface tension when the surface life length is 1,500 ms, as measured by maximum bubble pressure technique at 25 degrees C., discharging stability is good but uniformity of solid portion is inferior.

When the difference between the dynamic surface tension and the static surface tension fails to satisfy the condition of the present disclosure, the difference of the surface tension between ink droplets landed on a recording medium and ink droplets immediately before landing is practically nil. Therefore, when another following ink droplet lands adjacent to an ink droplet has already landed, both ink droplets are united. For this reason, displacement of landing position and beading occur, thereby degrading image quality. This phenomenon is significant on a recording medium having poor ink absorption property. When the difference between the dynamic surface tension and the static surface tension satisfies the condition of the present disclosure, liquid droplets are stably formed because of high dynamic surface tension immediately after the liquid droplets are discharged from a head and ink permeates into a sheet soon after landing on the sheet due to the low static surface tension, thereby preventing beading to occur.

Ink Preparation Examples 13 to 34

Each pigment dispersion manufactured in Manufacturing Examples 1 to 4 of Pigment Dispersion was used to prepare each ink of Ink Preparation Examples 13 to 34 according to the prescriptions shown in Tables 7 to 9 in the same manner as in Ink Preparation Example 1 and pH was adjusted to 9 by 10 percent aqueous solution of sodium hydroxide.

The values in Tables 7 to 9 is represented in percent by mass and the abbreviations are the same as those in Table 1.

TABLE 7

| | | Preparation examples of ink | | | | | | | |
|---|---|---|---|---|---|---|---|---|---|
| | | 13 | 14 | 15 | 16 | 17 | 18 | 19 | 20 |
| Manufacturing Example 1 of dispersion | C | 45.0 | | | | 25.0 | | | |
| Manufacturing Example 2 of dispersion | M | | 50.0 | | | | 35.0 | | |
| Manufacturing Example 3 of dispersion | Y | | | 40.0 | | | | 22.0 | |
| Manufacturing Example 4 of dispersion | K | | | | 50.0 | | | | 27.0 |
| Surfactant | Surfactant A | 0.05 | 0.05 | 0.05 | 0.03 | 0.03 | 0.03 | 0.03 | 0.02 |
| | Surfactant B | | | | | | | | |
| | Surfactant C | | | | | | | | |
| | Surfactant D | | | | | | | | |
| Organic solvent | Glycerin | | | | | 12.0 | 10.0 | 10.0 | 10.0 |
| | 3-methyl-1,3-butane diol | | | | | | 23.0 | | |
| | 1,3-butane diol | 7.0 | | 10.0 | | 24.0 | | | |
| | 1,2-butane diol | | | | 13.0 | | | | |
| | 1,2-propanediol | 28.0 | 38.0 | 30.0 | 26.0 | | | | |
| | 1,6-hexane diol | | | | | | | 24.0 | |
| | 1,5-pentane diol | | | | | | | | 20.0 |
| | 2-pyrroridone | | | | | | | | |
| | 2-ethyl-1,3-hexanediol | 2.5 | 2.5 | 2.5 | 2.5 | 4.0 | 4.0 | 4.0 | 4.0 |
| Foam inhibitor | 2,4,7,9-tetramethyldecane-4,7-diol | 0.30 | 0.30 | 0.30 | 0.30 | 0.20 | 0.20 | 0.20 | 0.20 |

TABLE 7-continued

| | | Preparation examples of ink | | | | | | | |
|---|---|---|---|---|---|---|---|---|---|
| | | 13 | 14 | 15 | 16 | 17 | 18 | 19 | 20 |
| Defoaming agent | KM-72F | | | | | | | | |
| Fungicides | PROXEL LV | 0.20 | 0.20 | 0.20 | 0.20 | 0.20 | 0.20 | 0.20 | 0.20 |
| pH regulator | 10 percent aqueous solution of sodium hydroxide | Proper quantity | Proper quantity | Proper quantity | Proper quantity | Proper quantity | Proper quantity | Proper quantity | Proper quantity |
| Deionized water | | Rest | Rest | Rest | Rest | Rest | Rest | Rest | Rest |
| Total | | 100.0 | 100.0 | 100.0 | 100.0 | 100.0 | 100.0 | 100.0 | 100.0 |

TABLE 8

| | | Preparation examples of ink | | | | | | | |
|---|---|---|---|---|---|---|---|---|---|
| | | 13 | 14 | 15 | 16 | 17 | 18 | 19 | 20 |
| Manufacturing Example 1 of dispersion | C | 45.0 | | | | 25.0 | | | |
| Manufacturing Example 2 of dispersion | M | | 50.0 | | | | 35.0 | | |
| Manufacturing Example 3 of dispersion | Y | | | 40.0 | | | | 22.0 | |
| Manufacturing Example 4 of dispersion | K | | | | 50.0 | | | | 27.0 |
| Surfactant | Surfactant A | 0.05 | 0.05 | 0.05 | 0.03 | 0.03 | 0.03 | 0.03 | 0.02 |
| | Surfactant B | | | | | | | | |
| | Surfactant C | | | | | | | | |
| | Surfactant D | | | | | | | | |
| Organic solvent | Glycerin | | | | | 12.0 | 10.0 | 10.0 | 10.0 |
| | 3-methyl-1,3-butane diol | | | | | | 23.0 | | |
| | 1,3-butane diol | 7.0 | | 10.0 | | 24.0 | | | |
| | 1,2-butane diol | | | | 13.0 | | | | |
| | 1,2-propanediol | 28.0 | 38.0 | 30.0 | 26.0 | | | | |
| | 1,6-hexane diol | | | | | | | 24.0 | |
| | 1,5-pentane diol | | | | | | | | 20.0 |
| | 2-pyrroridone | | | | | | | | |
| | 2-ethyl-1,3-hexanediol | 2.5 | 2.5 | 2.5 | 2.5 | 4.0 | 4.0 | 4.0 | 4.0 |
| Foam inhibitor | 2,4,7,9-tetramethyldecane-4,7-diol | 0.30 | 0.30 | 0.30 | 0.30 | 0.20 | 0.20 | 0.20 | 0.20 |
| Defoaming agent | KM-72F | | | | | | | | |
| Fungicides | PROXEL LV | 0.20 | 0.20 | 0.20 | 0.20 | 0.20 | 0.20 | 0.20 | 0.20 |
| pH regulator | 10 percent aqueous solution of sodium hydroxide | Proper quantity | Proper quantity | Proper quantity | Proper quantity | Proper quantity | Proper quantity | Proper quantity | Proper quantity |
| Deionized water | | Rest | Rest | Rest | Rest | Rest | Rest | Rest | Rest |
| Total | | 100.0 | 100.0 | 100.0 | 100.0 | 100.0 | 100.0 | 100.0 | 100.0 |

TABLE 9

| | | Preparation examples of ink | | | | | |
|---|---|---|---|---|---|---|---|
| | | 29 | 30 | 31 | 32 | 33 | 34 |
| Manufacturing Example 1 of dispersion | C | 23.0 | | | | | |
| Manufacturing Example 2 of dispersion | M | | 35.0 | | | | |

TABLE 9-continued

| | | Preparation examples of ink | | | | | |
|---|---|---|---|---|---|---|---|
| | | 29 | 30 | 31 | 32 | 33 | 34 |
| Manufacturing Example 3 of dispersion | Y | | | 20.0 | | | |
| Manufacturing Example 4 of dispersion | K | | | | 30.0 | 50.0 | 50.0 |
| Surfactant | Surfactant A | | | | | 0.20 | 0.005 |
| | Surfactant B | 1.50 | 1.50 | 1.50 | 2.50 | | |
| | Surfactant C | | | | | | |
| | Surfactant D | | | | | | |
| Organic solvent | Glycerin | 20.0 | 17.0 | 30.0 | 17.0 | | |
| | 3-methyl-1,3-butane diol | | | | 20.0 | | |
| | 1,3-butane diol | | 21.0 | 15.0 | | | |
| | 1,2-butane diol | 23.0 | | | | 13.0 | 13.0 |
| | 1,2-propanediol | | | | | 26.0 | 26.0 |
| | 1,6-hexane diol | | | | | | |
| | 1,5-pentane diol | | | | | | |
| | 2-pyrroridone | | | | | | |
| | 2-ethyl-1,3-hexanediol | 2.0 | 2.0 | 2.0 | 2.0 | 2.5 | 2.5 |
| Foam inhibitor | 2,4,7,9-tetramethyldecane-4,7-diol | | | | | 0.30 | 0.30 |
| Defoaming agent | KM-72F | 0.20 | 0.20 | 0.20 | 0.20 | | |
| Fungicides | PROXEL LV | 0.10 | 0.10 | 0.10 | 0.10 | 0.20 | 0.20 |
| pH regulator | 10 percent aqueous solution of sodium hydroxide | Proper quantity | Proper quantity | Proper quantity | Proper quantity | Proper quantity | Proper quantity |
| Deionized water | | Rest | Rest | Rest | Rest | Rest | Rest |
| Total | | 100.0 | 100.0 | 100.0 | 100.0 | 100.0 | 100.0 |

Property of Ink

Viscosity, static surface tension, and dynamic surface tension were measured for each ink of the Ink Preparation Examples 13 to 34 in the same manner as in Ink Preparation Example 1. The results are shown in Table 10.

TABLE 10

| | Viscosity (mPa · s) | Dynamic surface tension (mN/m) 15 ms | 150 ms | 1,500 ms | Static surface tension (mN/m) | Difference between surface tensions |
|---|---|---|---|---|---|---|
| Preparation example 13 of ink | 8.17 | 39.1 | 34.1 | 32.5 | 22.1 | G |
| Preparation example 14 of ink | 8.23 | 39.6 | 34.5 | 32.7 | 23.3 | G |
| Preparation example 15 of ink | 8.02 | 38.7 | 33.8 | 31.8 | 20.9 | G |
| Preparation example 16 of ink | 8.36 | 39.5 | 34.5 | 33.1 | 24.7 | A |
| Preparation example 17 of ink | 7.94 | 39.7 | 34.0 | 32.0 | 22.8 | G |
| Preparation example 18 of ink | 8.10 | 39.3 | 33.7 | 31.7 | 23.1 | G |
| Preparation example 19 of ink | 7.54 | 39.1 | 33.5 | 31.6 | 21.9 | G |
| Preparation example 20 of ink | 8.18 | 39.9 | 33.7 | 32.4 | 24.3 | G |

TABLE 10-continued

| | Viscosity (mPa · s) | Dynamic surface tension (mN/m) 15 ms | 150 ms | 1,500 ms | Static surface tension (mN/m) | Difference between surface tensions |
|---|---|---|---|---|---|---|
| Preparation example 21 of ink | 7.73 | 36.7 | 33.8 | 30.1 | 21.4 | G |
| Preparation example 22 of ink | 8.01 | 38.0 | 34.5 | 31.3 | 21.7 | G |
| Preparation example 23 of ink | 7.93 | 37.6 | 34.1 | 31.0 | 21.5 | G |
| Preparation example 24 of ink | 8.20 | 39.7 | 35.8 | 32.2 | 22.1 | G |
| Preparation example 25 of ink | 7.78 | 39.4 | 30.1 | 27.0 | 26.7 | P |
| Preparation example 26 of ink | 7.83 | 38.8 | 29.5 | 26.7 | 26.6 | P |
| Preparation example 27 of ink | 7.82 | 39.2 | 29.9 | 27.2 | 26.9 | P |
| Preparation example 28 of ink | 8.04 | 39.0 | 29.8 | 27.0 | 26.5 | P |
| Preparation example 29 of ink | 7.95 | 38.3 | 27.6 | 24.6 | 24.1 | P |
| Preparation example 30 of ink | 7.99 | 37.9 | 27.3 | 24.5 | 24.5 | P |

TABLE 10-continued

| | Viscosity (mPa · s) | Dynamic surface tension (mN/m) 15 ms | 150 ms | 1,500 ms | Static surface tension (mN/m) | Difference between surface tensions |
|---|---|---|---|---|---|---|
| Preparation example 31 of ink | 7.95 | 38.5 | 27.6 | 24.4 | 23.8 | P |
| Preparation example 32 of ink | 7.88 | 34.6 | 25.9 | 24.3 | 25.3 | P |
| Preparation example 33 of ink | 8.51 | 32.5 | 27.7 | 26.2 | 18.1 | G |
| Preparation example 34 of ink | 8.02 | 47.0 | 43.8 | 42.1 | 35.1 | G |

The inks obtained in Ink Preparation Examples 13 to 34 were used to prepare Ink Sets 1 to 7 having combinations shown in Table 11.

TABLE 11

| | | |
|---|---|---|
| Ink set 1 | C | Preparation example 13 of ink |
| | M | Preparation example 14 of ink |
| | Y | Preparation example 15 of ink |
| | K | Preparation example 16 of ink |
| Ink set 2 | C | Preparation example 17 of ink |
| | M | Preparation example 18 of ink |
| | Y | Preparation example 19 of ink |
| | K | Preparation example 20 of ink |
| Ink set 3 | C | Preparation example 21 of ink |
| | M | Preparation example 22 of ink |
| | Y | Preparation example 23 of ink |
| | K | Preparation example 24 of ink |
| Ink set 4 | C | Preparation example 25 of ink |
| | M | Preparation example 26 of ink |
| | Y | Preparation example 27 of ink |
| | K | Preparation example 28 of ink |
| Ink set 5 | C | Preparation example 13 of ink |
| | M | Preparation example 14 of ink |
| | Y | Preparation example 15 of ink |
| | K | Preparation example 33 of ink |
| Ink set 6 | C | Preparation example 13 of ink |
| | M | Preparation example 14 of ink |
| | Y | Preparation example 15 of ink |
| | K | Preparation example 34 of ink |
| Ink set 7 | C | Preparation example 29 of ink |
| | M | Preparation example 30 of ink |
| | Y | Preparation example 31 of ink |
| | K | Preparation example 32 of ink |

Examples 17 to 22 and Comparative Examples 21 to 35

The recording methods using each of the ink sets 1 to 7 are evaluated in the following manner.

The ink sets were evaluated in the same recording method as in Example 1 using the same inkjet printer as Example 1 except that the following was changed.

Before the discharging pulse forming the first droplet in a single print cycle, as illustrated in FIG. 19, the discharging pulse drawing in a meniscus by the inflation waveform element (rising down voltage changing portion) having a voltage changing time of 1/1 of the resonance period of the liquid in the head is determined as "waveform 1". Similarly, the discharging pulse drawing in a meniscus by the inflation waveform element (rising down voltage changing portion having a voltage changing time of ⅓ of the resonance period of the liquid in the head is determined as "waveform 2".

As illustrated in FIG. 20, the discharging pulse drawing in a meniscus by the inflation waveform element having a short voltage changing time of ¼ of the resonance period of the liquid in the head is determined as "waveform 3".

When using the "waveform 1", the discharging results of Ink Sets 1 to 3 are Examples 17 to 19 and the discharging results of Ink Sets 4 to 7 are Comparative Examples 21 to 24. When using the "waveform 2", the discharging results of Ink Sets 1 to 3 are Examples 20 to 22 and the discharging results of Ink Sets 4 to 7 are Comparative Examples 25 to 28. When using the "waveform 3", the discharging results of Ink Sets 1 to 3 are Examples 29 to 31 and the discharging results of Ink Sets 4 to 7 are Comparative Examples 32 to 35. In addition, before the evaluation, ink was attached to the surface of the nozzle plate and the surface was repeatedly wiped off by the wiper blade 4,000 times to intentionally degrade the repellent film on the surface of the nozzle plate.

Discharging Stability

Images were formed on MyPaper (manufactured by Ricoh Company Ltd.) by the inkjet printer (IPSio GXe3300, manufactured by Ricoh Company Ltd.). The print pattern had a print area of 5 percent for each color in the entire area of the sheet and was printed with each ink of yellow, magenta, cyan, and black 100% duty. The print conditions were that the recording density was 600 dpi with one pass printing and a print sample of the three waveforms of the waveform 1 to the waveform 3 was made. The sample was made by intermittent printing. That is, the print pattern was printed on 20 sheets continuously and the printing operation was halt for 20 minutes without discharging. This cycle was repeated 50 times to print the pattern on 1,000 sheets in total and thereafter the print pattern was printed on one more sheet, which was visually checked to evaluate the image with regard to streaks, dot missing, disturbance of jetting (discharging) of 5 percent chart solid portion.

The evaluation criteria are as follows. "G (good)" is allowed and "M (marginal)" and "P (poor)"

Evaluation Criteria

G: No streaks, no dot missing, no jetting disturbance observed in solid portion

M: Slight streaks, dot missing, and jetting disturbance observed in one or two sites in the solid portion P: Streaks, dot missing, jetting disturbance observed all over the solid portion Uniformity of Solid Printed Portion (Uniformity of Solid Portion)

Images were formed on Ricoh Business Coat Gloss (manufactured by Ricoh Company Ltd.) by the inkjet printer (IPSio GXe3300, manufactured by Ricoh Company Ltd.). The print pattern was printed with each ink of yellow, magenta, cyan, and black 100% duty. A print sample of the three waveforms of the waveform 1 to waveform 3 was made.

Uniformity on the solid portion of the thus-obtained sample was visually checked and evaluated. The evaluation criteria are as follows. "G (good)" is allowed and "M (marginal)" and "P (poor)"

Evaluation Criteria

G: Mottle observed little on the solid portion

M: Mottle observed slightly on the solid portion

P: Mottle observed all over the solid portion

Evaluation on Bleed Between Black Ink and Color Ink

Only "waveform 1" and "waveform 2" were used for evaluation.

Images were formed on MyPaper (manufactured by Ricoh Company Ltd.) by the inkjet printer (IPSio GXe3300, manufactured by Ricoh Company Ltd.). The print pattern was printed with each color ink 100% duty. The print conditions were that the recording density was 600 dpi with one pass printing. The samples were prepared by only using "waveform 1" and "waveform 2".

Texts in black ink were printed in the solid image of each color ink and bleed between color ink and black ink was visually checked and evaluated according to the following criteria. "G (good)" is allowed and "M (marginal)" and "P (poor)" are evaluated as failures.

Evaluation Criteria

G: Free of bleed and texts in black clearly recognized (with no bleed)

M: Bleed slightly occurred with slight bleed of texts in black

P: Bleed occurs and difficult to recognize texts in black

These evaluation results are shown in Tables 12 to 15. In addition, the cases in which the difference of the dynamic surface tension and the static surface tension of each ink satisfies the conditions specified above are shown in the same manner.

Furthermore, when the difference obtained by subtracting the static surface tension of any color ink from the static surface tension of the black ink was 0-4 mN/m, the evaluation was determined as "G (good)" and when the difference obtained by subtracting the static surface tension of any color ink from the static surface tension of the black ink was outside the range of 0-4 mN/m, the evaluation was determined as "P (poor)".

TABLE 12

| Ink set | | Combination of ink | Dynamic surface tension (mN/m) 15 ms | 150 ms | 1,500 ms | Static surface tension (mN/m) | Difference between surface tensions | Difference of static surface tension between black ink and color ink: Difference value (mN/m) | Evaluation |
|---|---|---|---|---|---|---|---|---|---|
| Ink set 1 | C | Preparation example 13 of ink | 39.1 | 34.1 | 32.5 | 22.1 | G | 2.6 | G |
| | M | Preparation example 14 of ink | 39.6 | 34.5 | 32.7 | 23.3 | G | 1.4 | |
| | Y | Preparation example 15 of ink | 38.7 | 33.8 | 31.8 | 20.9 | G | 3.8 | |
| | K | Preparation example 16 of ink | 39.5 | 34.5 | 33.1 | 24.7 | G | — | |
| Ink set 2 | C | Preparation example 17 of ink | 39.7 | 34.0 | 32.0 | 22.8 | G | 1.5 | G |
| | M | Preparation example 18 of ink | 39.3 | 33.7 | 31.7 | 23.1 | G | 1.2 | |
| | Y | Preparation example 19 of ink | 39.1 | 33.5 | 31.6 | 21.9 | G | 2.4 | |

TABLE 12-continued

| Ink set | | Combination of ink | Dynamic surface tension (mN/m) 15 ms | 150 ms | 1,500 ms | Static surface tension (mN/m) | Difference between surface tensions | Difference of static surface tension between black ink and color ink Difference value (mN/m) | Evaluation |
|---|---|---|---|---|---|---|---|---|---|
| | K | Preparation example 20 of ink | 39.9 | 33.7 | 32.4 | 24.3 | G | — | |
| Ink set 3 | C | Preparation example 21 of ink | 36.7 | 33.8 | 30.1 | 21.4 | G | 0.7 | G |
| | M | Preparation example 22 of ink | 38.0 | 34.5 | 31.3 | 21.7 | G | 0.4 | |
| | Y | Preparation example 23 of ink | 37.6 | 34.1 | 31.0 | 21.5 | G | 0.6 | |
| | K | Preparation example 24 of ink | 39.7 | 35.8 | 32.2 | 22.1 | G | — | |
| Ink set 4 | C | Preparation example 25 of ink | 39.4 | 30.1 | 27.0 | 26.7 | P | −0.2 | P |
| | M | Preparation example 26 of ink | 38.8 | 29.5 | 26.7 | 26.6 | P | −0.1 | |
| | Y | Preparation example 27 of ink | 39.2 | 29.9 | 27.2 | 26.9 | P | −0.4 | |
| | K | Preparation example 28 of ink | 39.0 | 29.8 | 27.0 | 26.5 | P | — | |
| Ink set 5 | C | Preparation example 13 of ink | 39.1 | 34.1 | 32.5 | 22.1 | G | −4.0 | P |
| | M | Preparation example 14 of ink | 39.6 | 34.5 | 32.7 | 23.3 | G | −5.2 | |
| | Y | Preparation example 15 of ink | 38.7 | 33.8 | 31.8 | 20.9 | G | −2.8 | |
| | K | Preparation example 33 of ink | 32.5 | 27.7 | 26.2 | 18.1 | G | — | |
| Ink set 6 | C | Preparation example 13 of ink | 39.1 | 34.1 | 32.5 | 22.1 | G | 13.0 | P |
| | M | Preparation example 14 of ink | 39.6 | 34.5 | 32.7 | 23.3 | G | 11.8 | |
| | Y | Preparation example 15 of ink | 38.7 | 33.8 | 31.8 | 20.9 | G | 14.2 | |
| | K | Preparation example 34 of ink | 47.0 | 43.8 | 42.1 | 35.1 | G | — | |
| Ink set 7 | C | Preparation example 29 of ink | 38.3 | 27.6 | 24.6 | 24.1 | P | 1.2 | G |
| | M | Preparation example 30 of ink | 37.9 | 27.3 | 24.5 | 24.5 | P | 0.8 | |
| | Y | Preparation example 31 of ink | 38.5 | 27.6 | 24.4 | 23.8 | P | 1.5 | |
| | K | Preparation example 32 of ink | 34.6 | 25.9 | 24.3 | 25.3 | P | — | |

TABLE 13

| | Waveform | Ink set | | | Discharging stability | Uniformity at solid portion | Bleed between black and color |
|---|---|---|---|---|---|---|---|
| Example 17 | 1 | Ink set 1 | C | Preparation example 13 of ink | G | G | G |
| | | | M | Preparation example 14 of ink | G | G | G |
| | | | Y | Preparation example 15 of ink | G | G | G |
| | | | K | Preparation example 16 of ink | G | G | — |
| Example 18 | 1 | Ink set 2 | C | Preparation example 17 of ink | G | G | G |
| | | | M | Preparation example 18 of ink | G | G | G |
| | | | Y | Preparation example 19 of ink | G | G | G |
| | | | K | Preparation example 20 of ink | G | G | — |
| Example 19 | 1 | Ink set 3 | C | Preparation example 21 of ink | G | G | G |
| | | | M | Preparation example 22 of ink | G | G | G |
| | | | Y | Preparation example 23 of ink | G | G | G |
| | | | K | Preparation example 24 of ink | G | G | — |
| Comparative Example 21 | 1 | Ink set 4 | C | Preparation example 25 of ink | M | M | M |
| | | | M | Preparation example 26 of ink | M | M | G |
| | | | Y | Preparation example 27 of ink | M | M | M |
| | | | K | Preparation example 28 of ink | M | M | — |
| Comparative Example 22 | 1 | Ink set 5 | C | Preparation example 13 of ink | G | G | C |
| | | | M | Preparation example 14 of ink | G | G | C |
| | | | Y | Preparation example 15 of ink | G | G | C |
| | | | K | Preparation example 33 of ink | G | G | — |
| Comparative Example 23 | 1 | Ink set 6 | C | Preparation example 13 of ink | G | G | A |
| | | | M | Preparation example 14 of ink | G | G | A |
| | | | Y | Preparation example 15 of ink | G | G | A |
| | | | K | Preparation example 34 of ink | G | G | — |
| Comparative Example 24 | 1 | Ink set 7 | C | Preparation example 29 of ink | M | M | G |

TABLE 13-continued

| Waveform | Ink set | | Discharging stability | Uniformity at solid portion | Bleed between black and color |
|---|---|---|---|---|---|
| | M | Preparation example 30 of ink | M | M | G |
| | Y | Preparation example 31 of ink | M | M | G |
| | K | Preparation example 32 of ink | M | M | — |

TABLE 14

| | Waveform | | Ink set | | Discharging stability | Uniformity at solid portion | Bleed between Black and color |
|---|---|---|---|---|---|---|---|
| Example 20 | 2 | Ink set 1 | C | Preparation example 13 of ink | G | G | G |
| | | | M | Preparation example 14 of ink | G | G | G |
| | | | Y | Preparation example 15 of ink | G | G | G |
| | | | K | Preparation example 16 of ink | G | G | — |
| Example 21 | 2 | Ink set 2 | C | Preparation example 17 of ink | G | G | G |
| | | | M | Preparation example 18 of ink | G | G | G |
| | | | Y | Preparation example 19 of ink | G | G | G |
| | | | K | Preparation example 20 of ink | G | G | — |
| Example 22 | 2 | Ink set 3 | C | Preparation example 21 of ink | G | G | G |
| | | | M | Preparation example 22 of ink | G | G | G |
| | | | Y | Preparation example 23 of ink | G | G | G |
| | | | K | Preparation example 24 of ink | G | G | — |
| Comparative Example 25 | 2 | Ink set 4 | C | Preparation example 25 of ink | M | M | M |
| | | | M | Preparation example 26 of ink | M | M | M |
| | | | Y | Preparation example 27 of ink | M | M | M |
| | | | K | Preparation example 28 of ink | M | M | — |
| Comparative Example 26 | 2 | Ink set 5 | C | Preparation example 13 of ink | G | G | P |
| | | | M | Preparation example 14 of ink | G | G | P |
| | | | Y | Preparation example 15 of ink | G | G | P |

TABLE 14-continued

| | Waveform | Ink set | | | Discharging stability | Uniformity at solid portion | Bleed between Black and color |
|---|---|---|---|---|---|---|---|
| | | | K | Preparation example 33 of ink | G | G | — |
| Comparative Example 27 | 2 | Ink set 6 | C | Preparation example 13 of ink | G | G | M |
| | | | M | Preparation example 14 of ink | G | G | M |
| | | | Y | Preparation example 15 of ink | G | G | M |
| | | | K | Preparation example 34 of ink | G | G | — |
| Comparative Example 28 | 2 | Ink set 7 | C | Preparation example 29 of ink | P | P | M |
| | | | M | Preparation example 30 of ink | P | P | M |
| | | | Y | Preparation example 31 of ink | P | P | M |
| | | | K | Preparation example 32 of ink | P | P | — |

TABLE 15

| | Wave-form | Ink set | | | Discharg-ing stability | Uniform-ity at solid portion |
|---|---|---|---|---|---|---|
| Comparative Example 29 | 3 | Ink set 1 | C | Preparation example 13 of ink | P | M |
| | | | M | Preparation example 14 of ink | P | M |
| | | | Y | Preparation example 15 of ink | P | M |
| | | | K | Preparation example 16 of ink | P | M |
| Comparative Example 30 | 3 | Ink set 2 | C | Preparation example 17 of ink | P | M |
| | | | M | Preparation example 18 of ink | P | M |
| | | | Y | Preparation example 19 of ink | P | M |
| | | | K | Preparation example 20 of ink | P | M |
| Comparative Example 31 | 3 | Ink set 3 | C | Preparation example 21 of ink | P | M |
| | | | M | Preparation example 22 of ink | P | M |
| | | | Y | Preparation example 23 of ink | P | M |
| | | | K | Preparation example 24 of ink | P | M |
| Comparative Example 32 | 3 | Ink set 4 | C | Preparation example 25 of ink | P | P |

TABLE 15-continued

| | Wave-form | Ink set | | | Discharg-ing stability | Uniform-ity at solid portion |
|---|---|---|---|---|---|---|
| | | | M | Preparation example 26 of ink | P | P |
| | | | Y | Preparation example 27 of ink | P | P |
| | | | K | Preparation example 28 of ink | P | P |
| Comparative Example 33 | 3 | Ink set 5 | C | Preparation example 13 of ink | P | M |
| | | | M | Preparation example 14 of ink | P | M |
| | | | Y | Preparation example 15 of ink | P | M |
| | | | K | Preparation example 33 of ink | P | M |
| Comparative Example 34 | 3 | Ink set 6 | C | Preparation example 13 of ink | P | M |
| | | | M | Preparation example 14 of ink | P | M |
| | | | Y | Preparation example 15 of ink | P | M |
| | | | K | Preparation example 34 of ink | P | P |
| Comparative Example 35 | 3 | Ink set 7 | C | Preparation example 29 of ink | P | P |
| | | | M | Preparation example 30 of ink | P | P |

TABLE 15-continued

| Wave-form | Ink set | | Discharg-ing stability | Uniform-ity at solid portion |
|---|---|---|---|---|
| | Y | Preparation example 31 of ink | P | P |
| | K | Preparation example 32 of ink | P | P |

1. Discharging Stability Evaluation:

According to Examples 17 to 22, it is found that when a drive pulse (discharging pulse) having an inflation waveform element (rising down voltage changing portion) having a time (voltage changing time, transition time) of ⅓ or more of the resonance period of the liquid chamber is used, good discharging stability is obtained even for ink having a large difference between the dynamic surface tension and the static surface tension.

2. Discharging Stability Evaluation:

By the comparison between Examples 17 to 22 and Comparative Examples 29 to 31, it is found that ink having a large difference between the static surface tension and the dynamic surface tension comes to have good discharging stability when a drive pulse having an inflation waveform element (rising down voltage changing portion) having a time (voltage changing time, transition time) of at least ⅓ of the resonance period of the liquid chamber is used.

3. Evaluation on bleed between black in and color ink: When Examples 17 to 22 are compared with Comparative Examples 21 to 23 and 25 to 27, it is found that unless the condition of the difference in the static surface tension: (the value obtained by subtracting the static surface tension of any color ink from the static surface tension of the black ink is 0-4 mN/m) is met, bleed occurs. This is because when ink permeates into a sheet, the static surface tension of black ink and color ink is not well-balanced, so that texts in black become thin or bled.

Other embodiments of the present disclosure are described below.

Embodiment A

One embodiment (Embodiment A) of the present disclosure is an inkjet recording method of discharging ink droplets by a pressure generated by the pressure generating device 121 in response to a signal, which is executed by an inkjet recording device including a recording head including a nozzle plate 103 having a nozzle to discharge droplets of ink, the liquid chamber 106 communicating with the nozzle, and the pressure generating device 121 to generate a pressure in the liquid chamber 106 and a signal generating device (the drive waveform generating unit 701 and the head driver 509) to generate the signal (a drive waveform including one or more drive pulses (discharging pulses)) applied to the pressure generating device 121. In addition, the following conditions 1 and 2 are satisfied:

1. The ink has a dynamic surface tension 10 mN/m or more greater than the static surface tension of the ink when the surface life length is 15 ms and 3 mN/m or more greater than the static surface tension of the ink when the surface life length is 1,500 ms, as measured by maximum bubble pressure technique at 25 degrees C.

2. The signal includes at least one drawing-in pulse in a single print cycle and the cycle of the drawing-in pulse is one third or more of a resonance period of the liquid chamber.

Embodiment B

One embodiment (Embodiment B) of the present disclosure is that, in Embodiment A, the signal supplies a drive signal including a single or multiple pulses in a single print cycle to discharge one or more droplets of the ink from a nozzle and has a draw-in pulse having a cycle of ⅓ or more of the resonance period of the liquid chamber 106 before the discharging pulse forming the first droplet.

Embodiment C

One embodiment (Embodiment C) of the present disclosure is an inkjet recording device including a recording head including a nozzle plate 103 having a nozzle to discharge droplets of ink, the liquid chamber 106 communicating with the nozzle, and a pressure generating device to generate a pressure in the liquid chamber 106 and a signal generating device (the drive waveform generating unit 701 and the head driver 509) to generate a signal (a drive waveform including one or more drive pulses (discharging pulses)) applied to discharge the droplets of ink by the pressure generated by the pressure generating device 121. In addition, the following two relations are satisfied:

1. The ink has a dynamic surface tension 10 mN/m or more greater than the static surface tension of the ink when the surface life length is 15 ms and 3 mN/m or more greater than the static surface tension of the ink when the surface life length is 1,500 ms, as measured by maximum bubble pressure technique at 25 degrees C.

2. The signal includes at least one drawing-in pulse in a single print cycle and the cycle of the drawing-in pulse is one third or more of a resonance period of the liquid chamber.

Embodiment D

One embodiment (Embodiment D) of the present disclosure is that, in Embodiment C, the signal supplies a drive signal including a single or multiple pulses in a single print cycle to discharge one or more droplets of ink from a nozzle and has a draw-in pulse having a cycle of ⅓ or more of the resonance period of the liquid chamber 106 before the discharging pulse forming the first droplet.

According to the present disclosure, an inkjet recording method is provided which is capable of stably discharging ink having a low static surface tension and obtaining images with high quality.

Having now fully described embodiments of the present invention, it will be apparent to one of ordinary skill in the art that many changes and modifications can be made thereto without departing from the spirit and scope of embodiments of the invention as set forth herein.

What is claimed is:

1. An inkjet recording method, comprising:

applying one or more drive pulses to a pressure generator of a recording head, the recording head including a nozzle plate having a nozzle, a liquid chamber communicating with the nozzle, and the pressure generator configured to generate a pressure in the liquid chamber; and discharging droplets of ink from the nozzle, wherein the following conditions 1 and 2 are satisfied, condition 1: the ink has a dynamic surface tension that is 10 mN/m or more greater than a static surface tension of the ink when a surface life length is 15 ms, and 3 mN/m or more greater than the static surface tension of the ink when the surface life length is 1,500 ms, as measured by maximum bubble pressure technique at 25 degrees C., and condition 2: at least one of the one or more drive pulses has a voltage changing portion to draw in the ink, the voltage changing portion having a changing time of one third or more of a resonance period of the liquid chamber.

2. The inkjet recording method according to claim 1, wherein the ink comprises a black ink and one or more color inks, wherein each of the black ink and the one or more color inks satisfies the condition 1, and wherein a difference obtained by subtracting a static surface tension of any of the one or more color inks from a static surface tension of the black ink is 0-4 mN/m.

3. The inkjet recording method according to claim 2, wherein the one or more drive pulses are applied to the pressure generator in a single print cycle to discharge the droplets of ink, and wherein a drive pulse forming a first droplet in the single print cycle satisfies the condition 2.

4. The inkjet recording method according to claim 2, wherein the nozzle plate has a repellent film on a surface on an ink discharging side.

5. The inkjet recording method according to claim 1, wherein the one or more drive pulses are applied to the pressure generator in a single print cycle to discharge the droplets of ink, and wherein a drive pulse forming a first droplet in the single print cycle satisfies the condition 2.

6. The inkjet recording method according to claim 1, wherein the nozzle plate has a repellent film on a surface on an ink discharging side.

7. The inkjet recording method according to claim 1, wherein the ink includes water, a coloring material, a surfactant, and an organic solvent.

8. The inkjet recording method according to claim 1, wherein a viscosity of the ink is 3-30 mPa·s at 25 degrees C.

9. The inkjet recording method according to claim 1, wherein, in the condition 2, the voltage changing portion has the changing time of ⅓ to 1/1 of the resonance period of the liquid chamber.

10. The inkjet recording method according to claim 1, wherein, in the condition 2, the voltage changing portion has the changing time of 1/1 of the resonance period of the liquid chamber.

11. An inkjet recording device, comprising:

a recording head including a nozzle plate including a nozzle, a liquid chamber communicating with the nozzle, and a pressure generator configured to generate a pressure in the liquid chamber to discharge droplets of ink; and a drive waveform generator configured to generate a drive pulse including one or more drive pulses applied to the pressure generator, wherein the following conditions 1 and 2 are satisfied, condition 1: the ink has a dynamic surface tension 10 mN/m or more greater than a static surface tension of the ink when a surface life length is 15 ms, and 3 mN/m or more greater than the static surface tension of the ink when the surface life length is 1,500 ms, as measured by maximum bubble pressure technique at 25 degrees C., and condition 2: at least one of the one or more drive pulses has a voltage changing portion to draw in the ink, the voltage changing portion having a changing time of one third or more of a resonance period of the liquid chamber.

12. The inkjet recording device according to claim 11, wherein the ink comprises a black ink and one or more color inks, wherein each of the black ink and the one or more color inks satisfies the condition 1, and wherein a difference obtained by subtracting a static surface tension of any of the one or more color inks from a static surface tension of the black ink is 0-4 mN/m.

13. The inkjet recording device according to claim 12, wherein the one or more drive pulses are applied to the pressure generator in a single print cycle to discharge the droplets of ink, and wherein a drive pulse forming a first droplet in the single print cycle satisfies the condition 2.

14. The inkjet recording device according to claim 12, wherein the nozzle plate has a repellent film on a surface on an ink discharging side.

15. The inkjet recording device according to claim 11, wherein the one or more drive pulses is applied to the pressure generator in a single print cycle to discharge the droplets of ink, and wherein a drive pulse forming a first droplet in the single print cycle satisfies the condition 2.

16. The inkjet recording device according to claim 11, wherein the nozzle plate has a repellent film on a surface on an ink discharging side.

17. The inkjet recording device according to claim 11, wherein the ink includes water, a coloring agent, a surfactant, and an organic solvent.

18. The inkjet recording device according to claim 11, wherein a viscosity of the ink is 3-30 mPa·s at 25 degrees C.

19. The inkjet recording device according to claim 11, wherein, in the condition 2, the voltage changing portion has the changing time of ⅓ to 1/1 of the resonance period of the liquid chamber.

20. The inkjet recording device according to claim 11, wherein, in the condition 2, the voltage changing portion has the changing time of 1/1 of the resonance period of the liquid chamber.

* * * * *